US008448295B2

(12) United States Patent
Vines et al.

(10) Patent No.: US 8,448,295 B2
(45) Date of Patent: May 28, 2013

(54) VACUUM CLEANER WITH ROTATING HANDLE

(75) Inventors: Brian Vines, Normal, IL (US); Donald Davidshofer, Bloomington, IL (US)

(73) Assignee: Electrolux Home Care Products, Inc., Charlotte, NC (US)

( * ) Notice: Subject to any disclaimer, the term of this patent is extended or adjusted under 35 U.S.C. 154(b) by 708 days.

(21) Appl. No.: 12/722,901

(22) Filed: Mar. 12, 2010

(65) Prior Publication Data

US 2011/0219581 A1 Sep. 15, 2011

(51) Int. Cl.
*A47L 9/00* (2006.01)
*A47L 9/10* (2006.01)
*A47L 9/20* (2006.01)

(52) U.S. Cl.
USPC ..... 15/411; 15/351

(58) Field of Classification Search
USPC ..... 15/411, 351
See application file for complete search history.

(56) References Cited

U.S. PATENT DOCUMENTS

| | | | | |
|---|---|---|---|---|
| 3,346,896 | A | 10/1967 | Arones | |
| 4,334,337 | A | 6/1982 | Miller et al. | |
| 5,323,510 | A | 6/1994 | Redding et al. | |
| 5,584,095 | A | 12/1996 | Redding et al. | |
| 6,006,401 | A | 12/1999 | Jailor et al. | |
| 6,920,665 | B2 | 7/2005 | Tucker | |
| 7,516,838 | B2 | 4/2009 | Dutschke | |
| 7,610,653 | B2 | 11/2009 | Courtney | |
| 2005/0235454 | A1 | 10/2005 | Courtney | |
| 2008/0040883 | A1 | 2/2008 | Beskow et al. | |
| 2008/0115313 | A1 | 5/2008 | Dyson et al. | |
| 2008/0263814 | A1 * | 10/2008 | Bassett et al. | 15/345 |
| 2009/0056058 | A1 * | 3/2009 | Finke et al. | 15/347 |
| 2009/0056065 | A1 | 3/2009 | Finke | |
| 2009/0064449 | A1 | 3/2009 | Newton et al. | |

FOREIGN PATENT DOCUMENTS

WO 2008/037955 4/2008

OTHER PUBLICATIONS

International Search Report mailed May 10, 2011, PCT/US11/27938 (2 pages).
International Search Report mailed May 13, 2011, PCT/US11/27957 (2 pages).

* cited by examiner

*Primary Examiner* — Bryan R Muller
(74) *Attorney, Agent, or Firm* — Ratnerprestia

(57) ABSTRACT

A vacuum cleaner having a base to move on a surface, an intermediate member having a first and second passages, and a first joint connecting the base to the intermediate member to permit relative rotation between the base and the intermediate member about a first axis that is generally parallel to the surface and perpendicular to a direction of movement. An air passage connects a base inlet to the first intermediate member passage. A second joint connects a handle to the intermediate member and permits rotation between the intermediate member and the handle about a second axis that is parallel to a nominal direction of movement of the vacuum. The handle has a grip a dirt collector to receive and separate dirt from air. First and second passages connect the intermediate member passages to the dirt collector inlet and outlet. A vacuum fan draws air into the base air inlet, through the intermediate member, through the dirt collector, through the second handle air passage, and back into the intermediate member. At least one of the first and second passages jointing the intermediate member to the dirt collector is a flexible hose that is offset from the second axis and is adapted to flex to permit the handle to rotate relative to the intermediate member.

29 Claims, 22 Drawing Sheets

VACUUM CLEANER WITH ROTATING HANDLE

FIELD OF THE INVENTION

The present invention relates to floor cleaners and various features that may be used with vacuum cleaners. For example, the present invention relates to floor cleaners such as upright devices that include a handle used by an operator to propel the device over a surface to be cleaned.

BACKGROUND OF THE INVENTION

Various types of floor cleaning implements are known in the art. Vacuum cleaners typically come in either the upright, canister, or stick type configurations. One feature of a typical upright vacuum cleaner is a base unit that carries an upper body containing a dirt and/or dust collection container. The upper body is typically tiltable relative to the base unit. The tiltable upper body has two positions: a parked position and an operating position. In the parked position, the upper body can be held in a nearly upright position when the base unit is located on a horizontal floor. In this position, the upper body stands unsupported. During operation—that is, vacuuming—the upper body is tilted back from the parked position through a certain range of operating angles. The actual operating tilt angle or angle range may depend on such variables as the expected height of the operator, the particular purpose of use, or the structural design of the tilting mechanism. The operating position typically comprises free movement through the operating angle, but it may be possible to lock or resiliently hold the upper body in certain discrete angular positions that are tilted back from the parked position. A lock mechanism typically is provided to resiliently or rigidly hold the upper body in the parked position, and this lock may be released by a mechanism of some form that is typically actuated by the operator.

A typical vacuum cleaner also includes a handle provided on the upper body for maneuvering the vacuum cleaner when it is in the operating position. The handle may be a separate part or integrally formed with the upper body. A typical vacuum also includes a motor-fan unit, located either in the base unit or upper body, or in a remove vacuum in the case of central vacuum cleaners, to generate airflow through the vacuum cleaner to allow it to function as a vacuum. An airflow path, typically formed by hoses and/or ducting, is established between the base unit and upper body.

These conventional upright vacuum cleaners have a disadvantage in that they can be difficult to maneuver about an area in which they are used. They can be pushed and pulled easily enough, but pointing the cleaner in a new direction is more difficult. The cleaner can be pointed in a new direction by applying a sideways directed force to the handle, either from standstill or while moving the cleaner forwards or backwards. This causes the cleaner head to be dragged across the floor surface so that it points in a new direction. The only articulation between the base unit and the upper body is about a single pivot axis oriented parallel to the floor, and perpendicular to the fore-aft axis of movement. In most upright vacuum cleaners, a one or more sets of supporting wheels are mounted on the base unit to aid in moving the vacuum cleaner across the surface to be cleaned.

Attempts have been made to increase the maneuverability of upright vacuum cleaners or canister and central vacuum cleaner wand units. Some examples are shown in U.S. Pat. Nos. 5,323,510 and 5,584,095, the disclosures of which are incorporated herein by reference. In both of these patents, the vacuum cleaners have a base that includes a motor housing and a pair of wheels. A connection between the base and the main body incorporates joints that permit articulation about multiple axes. One part of the joint provides typical backwards tilting as described above (i.e., rotational movement of the main body with respect to the base about a first axis that is parallel with both the horizontal plane (i.e., the floor) and the rotational axis of the wheels). Another part of the joint provides swiveling movement about a second axis oriented perpendicular to the rotational axis of the wheels and inclined with respect to the horizontal plane. U.S. Patent Application Publication Number 2009/0056065, which is also incorporated herein by reference, shows a similar arrangement.

U.S. Pat. No. 7,610,653, which is incorporated herein by reference, shows an upright vacuum cleaner with a main body having a user-operable handle, and a support assembly that is mounted to the main body and arranged to roll with respect to the main body for allowing the appliance to be rolled along a surface by means of the handle. The support assembly is rounded to permit the main body to tilt laterally, and the provision of this rolling support assembly aids maneuverability of the cleaner.

Other prior art devices include support wheels that are mounted on casters that permit the wheels to swivel about a vertical axis. Such devices provide maneuverability because they allow the user to move the base laterally or rotate is about a vertical axis without lifting it from the floor, but these devices can be difficult to push in a straight line when desired and the use of casters may require some lateral movement each time the user transitions from forward to backwards movement.

Other prior vacuum cleaners use a universal-type joint that provides two rotation axes between the base and the upper body. An example of such a device is shown in U.S. Patent Application Publication Number 2008/0040883, which is incorporated herein by reference. In these devices, a first pivot provides typical backwards tilting, and another pivot provides a similar tilting movement in the lateral direction. The lateral tilt pivot is generally perpendicular to the long axis of the upper body, and allows the upper body to pivot left and right relative to the base.

The present invention provides unique alternatives to known cleaning devices, and various new and useful features that may be used with otherwise conventional cleaning devices.

SUMMARY OF THE INVENTION

In one exemplary aspect, there is provided a vacuum cleaner having a base adapted to move on a surface and having a base air inlet facing the surface. An intermediate member having a first intermediate member passage and a second intermediate member passage is connected to the base by a first joint. The first joint permits relative rotation between the base and the intermediate member about a first axis that is generally parallel to the surface and perpendicular to a nominal direction of movement of the vacuum cleaner. A base air passage fluidly connects the base air inlet to the first intermediate member passage. The vacuum cleaner has a handle with a grip adapted to be held by an operator and a dirt collector with a collector inlet and a collector outlet. The dirt collector is adapted to receive air into the collector inlet, separate dirt from the air, and exhaust the air out of the collector outlet. A second joint connects the handle to the intermediate member, and permits relative rotation between the intermediate member and the handle about a second axis that is generally parallel to a nominal direction of movement of the vacuum cleaner. A first handle air passage connects the first intermediate member passage to the dirt collector inlet. A second handle air passage connects the second intermediate member passage to the dirt collector outlet. A vacuum fan is provided and adapted to selectively draw the air into the base air inlet, through the base air passage, through the first intermediate member passage, through the dirt collector, through the second handle air passage, and into the second intermediate member passage, in that order. At least one of the first handle air passage and the second handle air passage includes a flexible hose that is offset from the second axis and is adapted to flex to permit the handle to rotate relative to the intermediate member.

In another exemplary aspect, there is provided a vacuum cleaner having a base adapted to move on a surface and having a base air inlet facing the surface. An intermediate member having a vacuum fan housed in it is connected to the base by a first joint. The first joint permits relative rotation between the base and the intermediate member about a first axis that is generally parallel to the surface and perpendicular to a nominal direction of movement of the vacuum cleaner. The vacuum cleaner has a handle with a grip adapted to be held by an operator and a dirt collector with a collector inlet and a collector outlet. The dirt collector is adapted to receive air into the collector inlet, separate dirt from the air, and exhaust the air out of the collector outlet. A second joint connects the handle to the intermediate member, and permits relative rotation between the intermediate member and the handle about a second axis that is generally parallel to a nominal direction of movement of the vacuum cleaner. A first air passage fluidly connects the base air inlet to the dirt collector inlet and a second air passage fluidly connects the dirt collector outlet to the vacuum fan. At least one of the first air passage and the second air passage includes a flexible hose that passes the second joint at a location offset from the second axis. The vacuum fan is adapted to draw the air into the base air inlet, through the first air passage, through the dirt collector, and through the second air passage, and into the vacuum fan, in that order.

In another exemplary aspect, there is provided a vacuum cleaner having a base adapted to move on a surface and having a base air inlet facing the surface. An intermediate member is connected to the base by a first joint. The first joint permits relative rotation between the base and the intermediate member about a first axis that is generally parallel to the surface and perpendicular to a nominal direction of movement of the vacuum cleaner. The vacuum cleaner has a handle with a dirt collector that has a collector inlet and a collector outlet. The dirt collector is adapted to receive air into the collector inlet, separate dirt from the air, and exhaust the air out of the collector outlet. A second joint connects the handle to the intermediate member, and permits relative rotation between the intermediate member and the handle about a second axis that is generally parallel to a nominal direction of movement of the vacuum cleaner. The second joint includes least one bearing having a bearing perimeter that is radially offset from the second axis. A first air passage fluidly connects the base air inlet to the dirt collector inlet, and a second air passage fluidly connects the dirt collector outlet to the vacuum fan. The first air passage and the second air passage include respective flexible hoses that pass the second joint at a location within the bearing perimeter.

The recitation of this summary of the invention is provided for exemplary and illustrative purposes, and is not intended to limit the scope of the invention.

BRIEF DESCRIPTION OF THE DRAWINGS

Purposes and advantages of the exemplary embodiments of the invention described herein will be apparent to those of ordinary skill in the art from the following detailed description in conjunction with the appended drawings in which like reference characters are used to indicate like elements.

DETAILED DESCRIPTION OF EXEMPLARY EMBODIMENTS

The following description is intended to convey an understanding of the inventions disclosed herein by describing various exemplary embodiments of floor cleaner components and systems. It should be appreciated, however, that the present invention is not limited to these exemplary embodiments and details, the appended figures, the summary of the invention, the abstract, or to the other specific disclosures herein. It is further understood that one possessing ordinary skill in the art, in light of known systems and methods taken in conjunction with the teachings herein, would appreciate the use of the invention for its intended purposes and benefits in any number of alternative embodiments, depending upon specific design needs and other considerations.

The terminology used herein is for the purpose of describing particular embodiments only, and is not intended to limit the scope of the present invention. As used throughout this disclosure, the singular forms "a," "an," and "the" include the plural unless there is specific instruction to the contrary or the context clearly dictates otherwise. Thus, for example, a reference to "a bearing" includes a plurality of such bearings, as well as a single bearing and equivalents or variations thereof known to those skilled in the art. Unless defined otherwise, all technical and scientific terms used herein have the same meanings as commonly understood by one of ordinary skill in the art to which this invention belongs.

FIGS. 1 through 4 illustrate an exemplary embodiments of a cleaning device 100 that may embody or incorporate one or more features of the embodiments described herein. The cleaning device 100 may be usable to clean and remove dirt and/or debris from various surfaces. For example, the various surfaces which may be cleaned include smooth, rough, and/or hard surfaces, such as linoleum, tile, hardwood, carpet, and other flooring that may be found inside and outside a house, an office, a building, or elsewhere. The cleaning device 100 may be used, for example, to clean dirt, soil, dust, lint, hair, combinations thereof, and/or other types of dirt and grime found on these various surfaces. The cleaning device 100 may include various attachments, coupled to the vacuum source of the cleaning device 100, to aid in cleaning these surfaces. For example, cleaning device 100 may include attachments that enable cleaning of the corners of a room and along wall edges by the operator. These attachments may be connected to the cleaning device 100 by flexible hosing, enabling the reach of the cleaning device 100 to be extended. The cleaning device 100 may be used in both residential and commercial environments.

Figure 1:
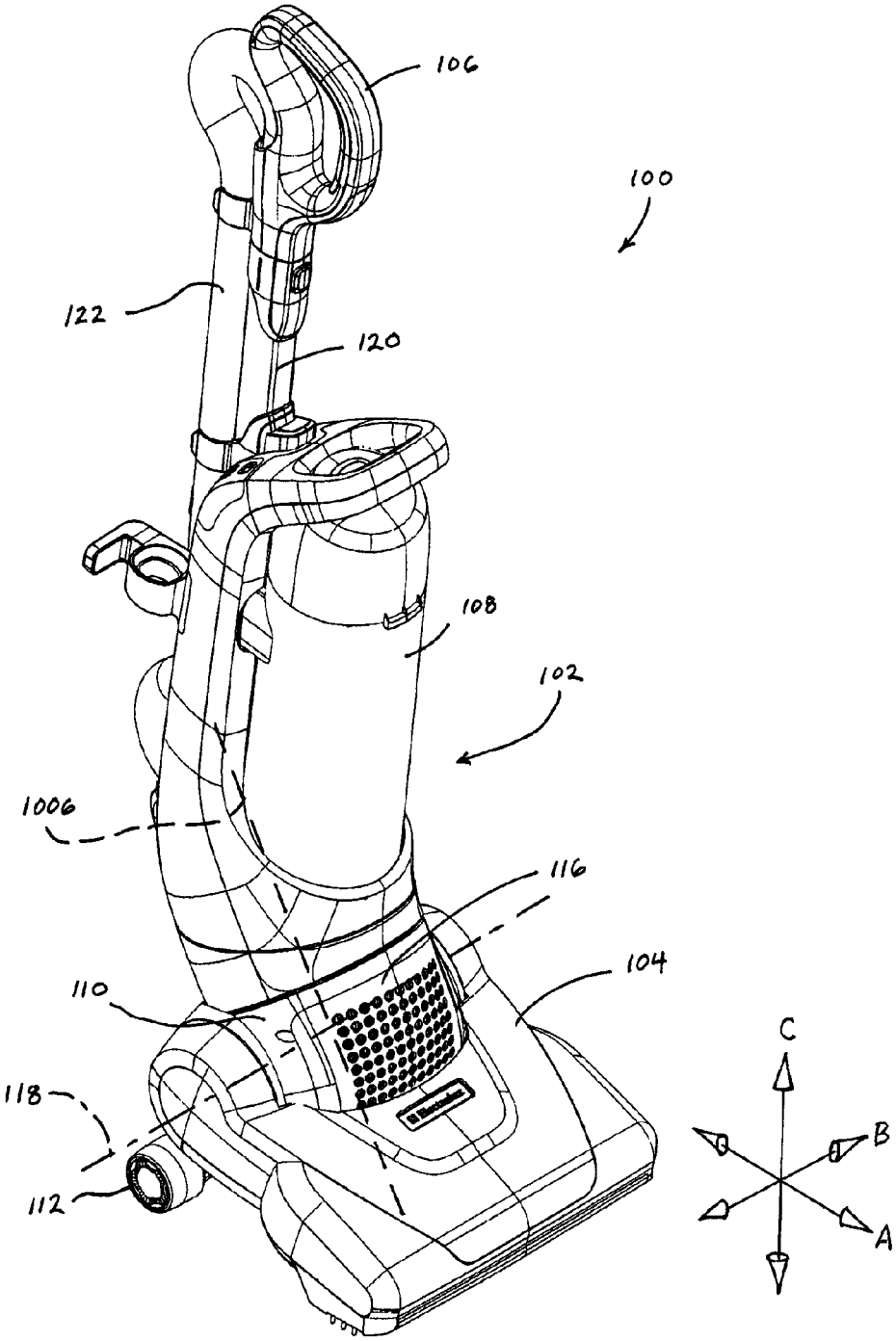
FIG. 1 is a perspective view of an exemplary embodiment of a cleaning device.

To facilitate the following descriptions, embodiments of the invention are described with respect to reference directions shown in FIG. 1. Specifically, the term "horizontal" refers to directions in a plane parallel to a typical flat surface on which the device 100 may be operated. The terms "forward," "rearward," "fore-aft," and similar terms refer to the nominal direction of movement of the device 100 (i.e., the direction of movement when no steering or turning is being performed), and is shown by Arrow A in FIG. 1. The terms "lateral," "left," "right," "sideways," "side-to-side" and similar terms refer to a direction in the horizontal plane that are perpendicular to the fore-aft direction. The lateral direction is shown by Arrow B in FIG. 1. (Arrows A and B lie in the horizontal plane.) The terms "vertical," "up," "down," and similar terms refer to a direction perpendicular to the horizontal plane. The vertical direction is shown by Arrow C in FIG. 1. The foregoing terms are used to convey a better understanding of various embodiments described herein, and are not intended to limit the invention. It will be understood that these directions may change as the embodiments are moved or used on other surfaces or in other orientations. For example, an embodiment may be used to clean a sloped surface, in which case the "horizontal" direction may not necessarily correspond with a gravitational horizontal plane. Such perceived variations or discrepancies should not be construed to limit the description or the invention in any way. Where necessary or helpful, various orientations and directions also may be described with respect to particular parts of the embodiments described herein.

As depicted in FIGS. 1 through 4, the cleaning device 100 generally includes an upper assembly 102 and a base 104. The upper assembly 102 has a grip 106, a dirt collector 108 and a motor housing 110. The grip 106 is provided to maneuver the lower assembly 104 over the cleaning surface, and may have any shape useful for doing so. For example, the grip 106 may comprise one or more ovate loops into which the user can insert a hand.

The dirt collector 108 is provided to separate and contain dirt and dust that is removed from the floor or other surface by the cleaning device 100. The dirt collector 108 may employ various techniques as known in the art to clean the air, such as one or more cyclonic or inertial separation chambers, bag filters or other kinds of filters, and the like. The dirt collector 108 may be removable from the cleaning device 100 to empty collected dirt, as known in the art. Alternatively, the dirt collector may remain attached to the device 100, and opened or otherwise accessed to remove dirt, as is typical with vacuum cleaners using bag filters.

The motor housing 110 contains a suitable fan and motor assembly, as known in the art. When activated, the fan/motor generates a suction force to draw air into the cleaning device 100. An exhaust outlet 116 may be provided adjacent the motor housing 110 or elsewhere on the device 100 to exhaust air passing through the device 100. One or more filtration devices may be provided to filter air passing through the exhaust outlet 116, as known in the art.

The cleaning device 100 may be supported by a rear wheel assembly 112, and one or more front wheels 114 (FIG. 4), or by any other suitable support devices, such as skids, plates, a bed of pressurized air, or the like, as known in the art.

A power cord (not shown) may be provided on either the upper assembly 102 or the base 104. Alternatively, the cleaning device may operate using a rechargeable or replaceable power source, such as one or more batteries or the like. In some embodiments, the cleaning device 100 may incorporate multiple power sources.

The cleaning device 100 also may have various other additional features as known in the art. For example, the cleaning device 100 may incorporate one or more additional cleaning tools, an accessory wand and hose for reaching above the floor and in difficult to reach areas, a fluid deposition system to allow for use as a wet extractor-type device, a lighting system, and so on.

As explained below, the cleaning device 100 may include one or more features that are intended to enhance the maneuverability of the device. Embodiments of such features include a movable rear wheel assembly 112 and a pivoting upper assembly 102. These, and other features described herein, may be modified in other embodiments and may be used separately, together or in various combinations. The illustration of particular embodiments and combinations of features are not intended to limit the scope of the various inventions in any way.

Figure 5:
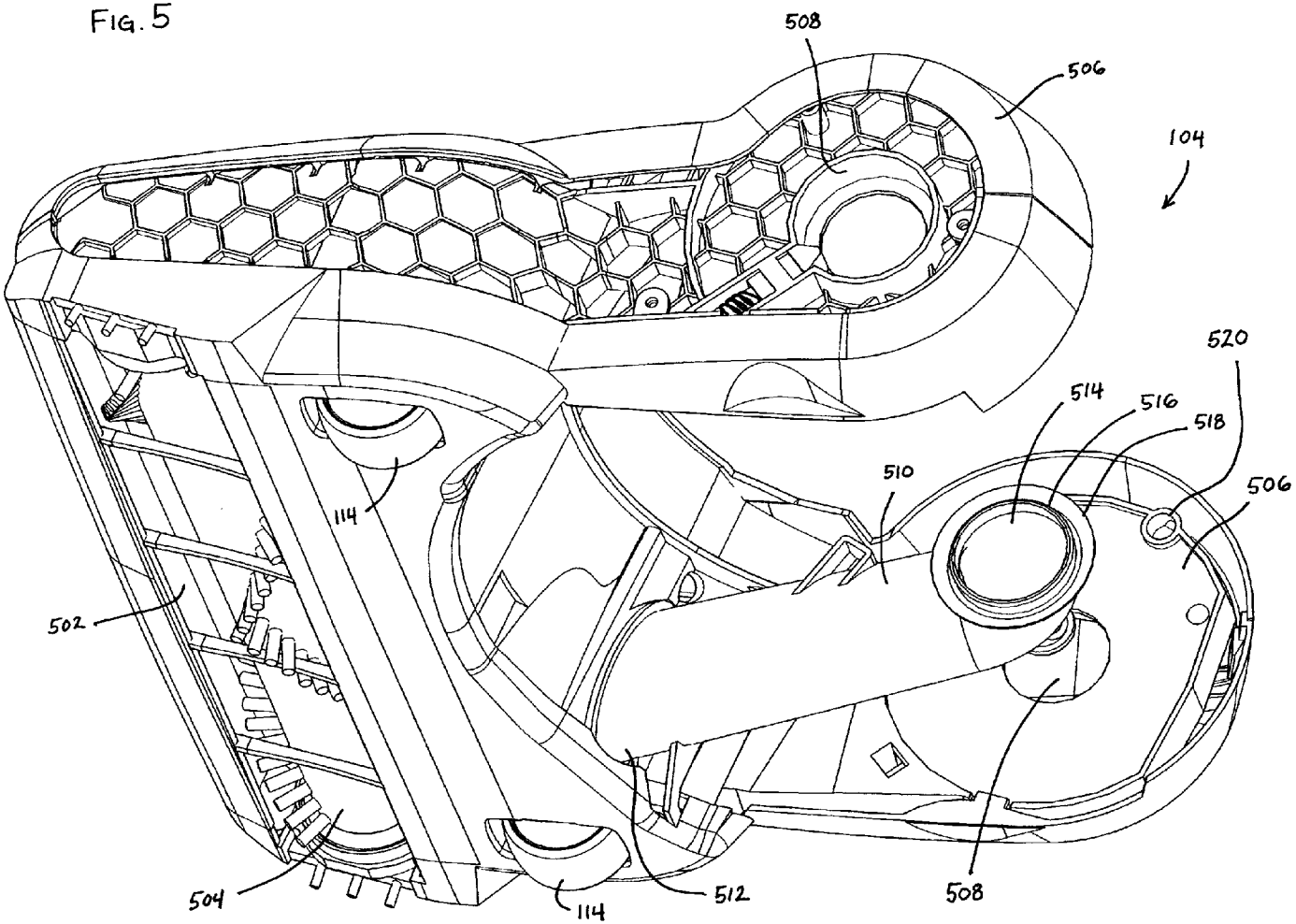
FIG. 5 is a perspective view of an exemplary base for a cleaning device.
Figure 6:
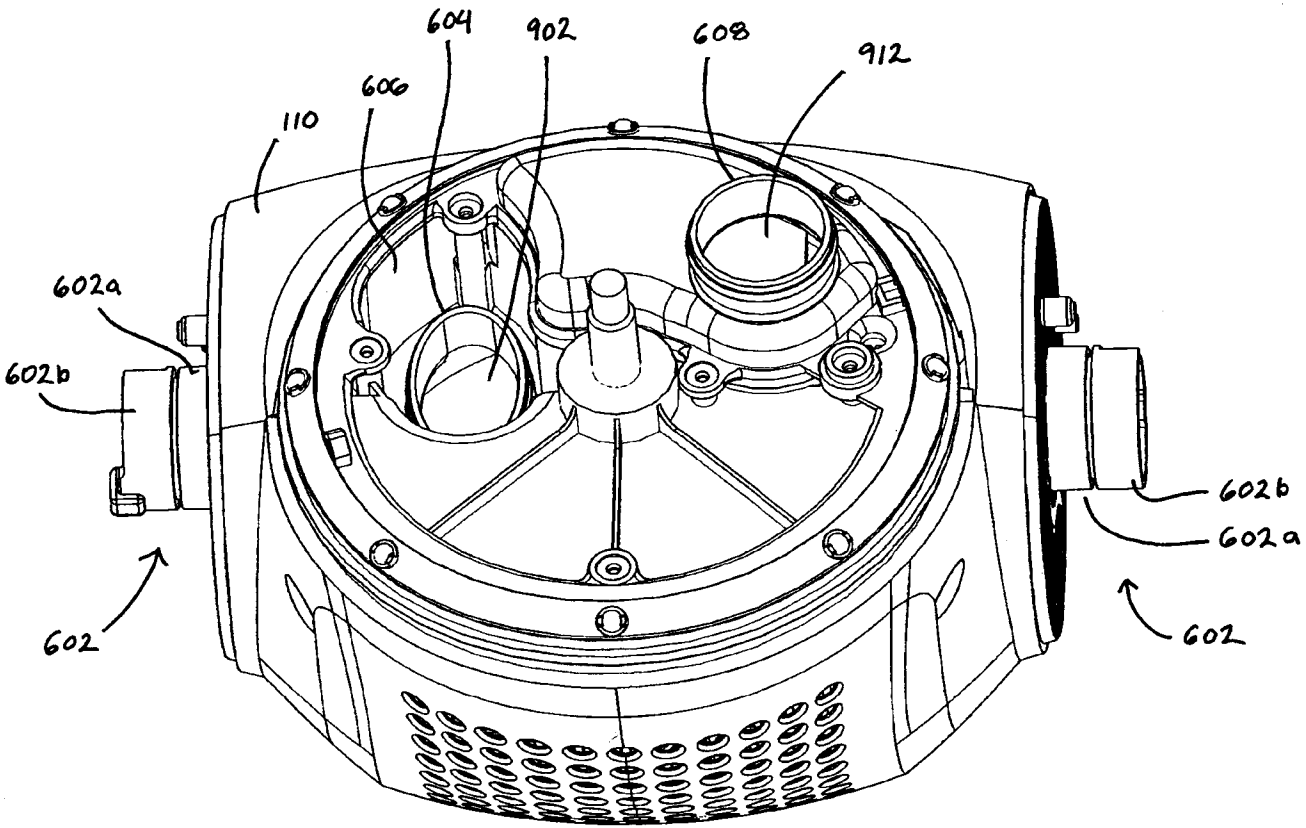
FIG. 6 illustrates an exemplary motor housing for a cleaning device.
Figure 7:
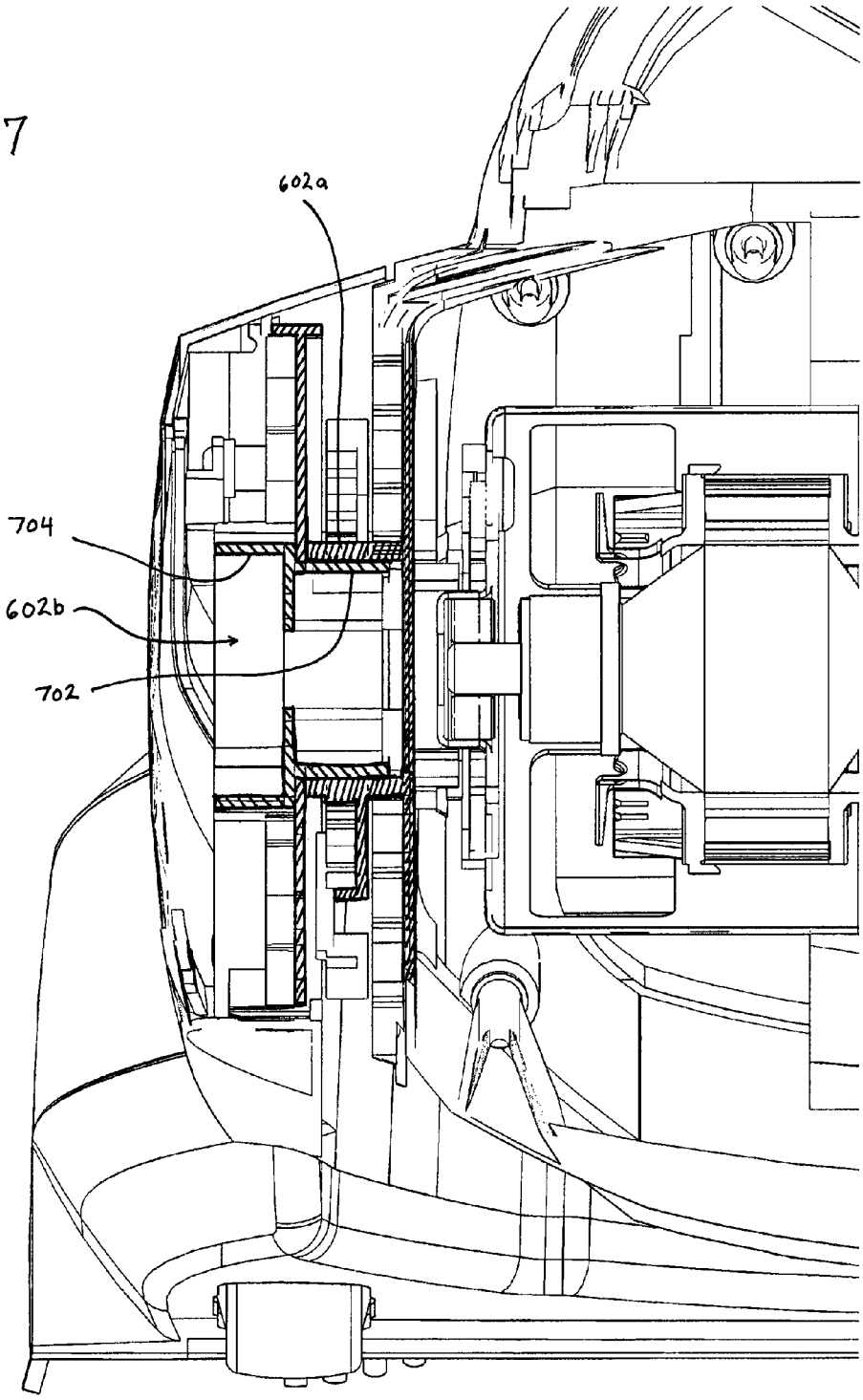
FIG. 7 is a cutaway rear elevation view showing an exemplary base-to-motor housing pivot arrangement.

Referring now to FIGS. 5-7, an exemplary pivoting connection between the base 104 and the upper assembly 102 is described in detail. As used herein, the term "pivot" refers to relative rotational movement regardless of whether such rotation is restricted through a range or movement, and is understood to be synonymous with terms such as "rotate" and "swivel" and variations thereof. These terms are understood to include true pivots—i.e., those having a single pivot pin and a circular rotating element—as well as virtual pivots that may exactly or approximately simulate true pivoting about a single axis.

As shown in FIG. 5, the base 104 (shown partially disassembled) includes an inlet nozzle 502 located on the bottom of the base 104 to be adjacent a surface to be cleaned. For ease of reference the surface to be cleaned is referred to herein simply as a "floor," but it will be understood that the term "floor" can include virtually any surface on which the base 104 is operated. A rotating agitator 504 may be positioned in the inlet nozzle 502, and powered by a motor (not shown) to contact the floor to help release dirt and debris, as known in the art. The motor may be a separate motor dedicated to driving the agitator 504, or it may be the same motor that drives the vacuum fan. Two front wheels 114 are located just behind the inlet nozzle 502. The front wheels 114 may be adjustable to raise and lower the inlet nozzle 502 with respect to the floor, as known in the art.

The base 104 may include a pair of yoke arms 506 that extend backwards from the nozzle 502. The yoke arms 506 connect the base 104 to the upper assembly 102 and permit pivoting between the base 104 and upper assembly 102 about a base pivot axis 118 (FIGS. 1-3) oriented generally parallel to the lateral direction B. Any suitable pivot mechanism may be used to join the base 104 to the upper assembly 102. The pivot mechanism preferably permits backwards tilting of the upper assembly 102 relative to the base 104. That is, the cleaning device 100 has front and rear sides, and the pivot mechanism permits the upper assembly 102 to rotate towards the rearward direction. The pivot mechanism may also permit forward tilting (i.e., pivoting towards the front of the device), but this is not necessary. Any suitable range of backward tilting may be provided. For example, a backwards tilt range of about 90 degrees may be provided, starting at a nominal 0 degrees from vertical at the upright "parked" position and ending 90 degrees at a fully laid-back position. It will be appreciated that the upper assembly 102 may assume a forward lean when it is at the upright parked position, and therefore measurement of the angle of lean may be measured from the parked position as a nominal "vertical" position to provide a consistent basis for measurement.

In the shown embodiment, each yoke arm 506 includes a pivot hole 508 that receives a corresponding pivot post 602 extending from each side of the motor housing 110. The pivot holes 508 and pivot posts 602 are shaped and sized to provide smooth pivoting movement between the two parts, and may include bearings or bearing surfaces as known in the art. The base pivot axis 118 passes through the rotational centers of the pivot holes 508.

Each pivot post 602 may include an assembly of parts, such as a cylindrical post 602*a* that extends from the motor housing 110, and an extension 602*b* that is connected to each post 602*a*. In embodiments in which the fan/motor 906 is used to drive a brushroll in the base 104 (as opposed to not using a driven brushroll or using a separate motor in the base to drive the brushroll), one post 602 may include a hole through which a drive shaft from the motor extends to provide a pulley mount for a brushroll drive belt. As shown in FIG. 7, each extension 602*b* may include a first portion 702 formed as a sleeve that fits inside each cylindrical post 602*a*, and a second portion 704 formed as an enlarged end. Each pivot hole 508 may be sized to fit over and bear upon the end of the first portion 702, and the second portion 704 may be sized to capture the pivot holes 508 in place against the end of each cylindrical post 602*a*. In this way, the pivot holes 508 are retained in place but still can rotate on the pivot posts 602.

A pivot lock may be provided to hold the base 104 in one or more positions relative to the upper assembly 102. As understood herein, a pivot lock can be a device that positively locks the two parts to one another until the device is manually released by an operator, or a device that resiliently holds the two parts relative to one another but that can be defeated by applying sufficient force to move the base 104 relative to the upper housing 102.

Figure 8A:
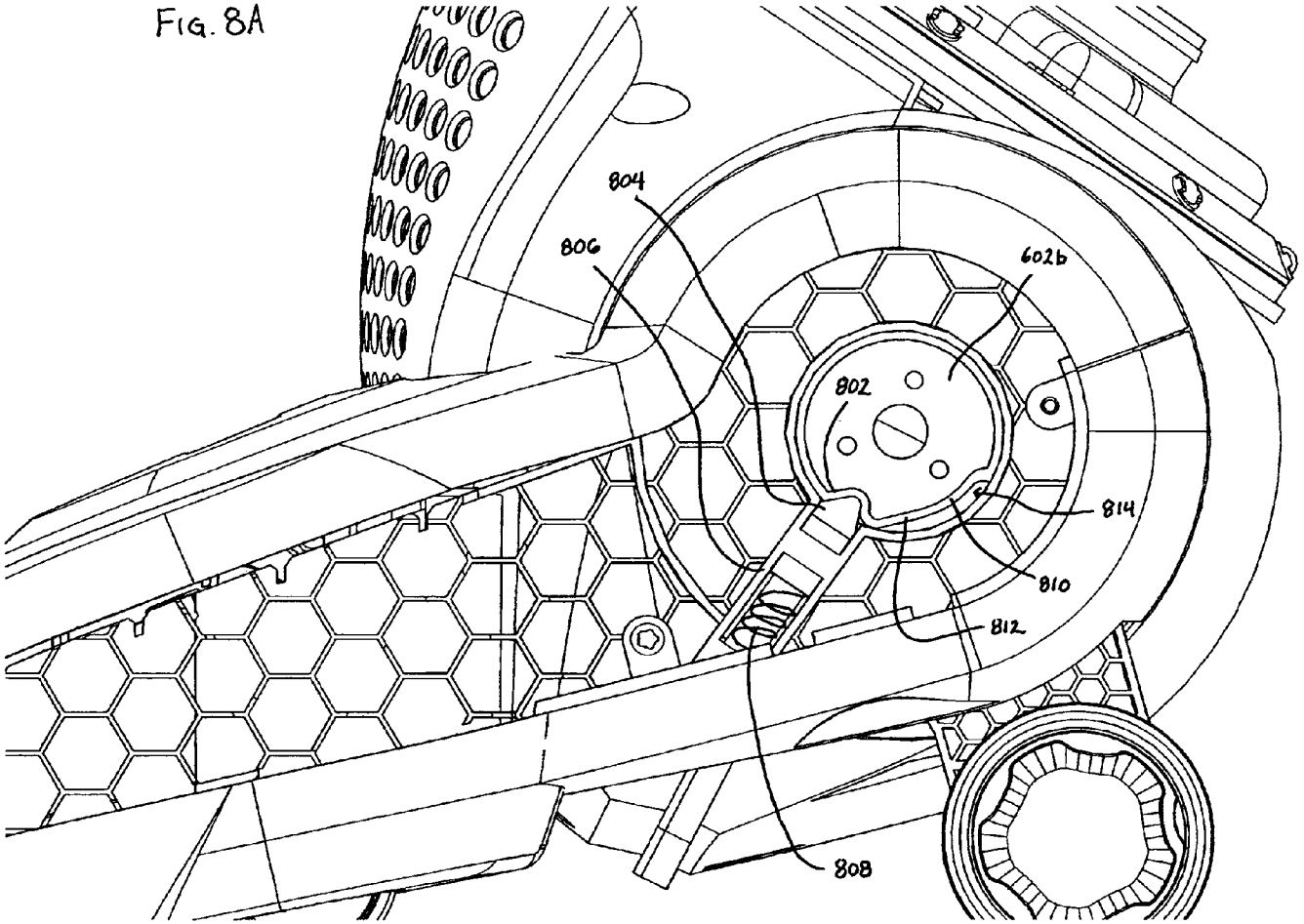
FIG. 8A is a side view of an exemplary pivot lock arrangement.

One example of a pivot lock is shown in FIG. 8A. In this embodiment, the second portion 704 of the pivot post extension 602*b* comprises a generally cylindrical surface having a detent 802 into which a retainer pin 804 fits. The retainer pin 804 is captured in a track 806 formed on the base yoke arm 506, which permits the pin 804 to move towards and away from the post extension 602*b*. A spring 808 is provided between the pin 804 and an end of the track 806 to bias pin 804 towards the post extension 602*b*. When the upper assembly 102 is in the upright position, the detent 802 is aligned with the pin 804, and the spring moves the pin 804 into the detent 802 to hold the base 104 and upper assembly 102 together against rotation. The pin 804 and detent 802 may be tapered, such as shown, so that a force applied to lean the upper assembly 102 backwards relative to the base 104 will force the pin 804 back against the spring 808 and thereby unlock the upper assembly 102 from the base 104 to allow free rotation.

The generally cylindrical outer surface of the post extension 602*b* may also include a recessed track 810 in which the end of the pin 804 is located as the upper assembly 102 pivots backwards. The exemplary track 810 is shallow at a first location 812 immediately adjacent the detent 802 to require full retraction of the pin 804 before the upper housing 102 pivots backwards. Beyond the first location 812, the track 810 is somewhat deeper to allow the pin 804 to extend into the post extension 602*b*. Providing this deeper track portion 814 alleviates pressure on the spring 808 and reduces friction between the pin 804 and track 810 that might resist free pivoting of the parts. In order to place the upper assembly 102 back into the parked position, the user must pivot it forward so that the shallow part of the track 810 forces the pin 804 back until it snaps back in place into the detent. This action may provide some resistance to placing the device 100 in the parked position, which may be desirable to prevent inadvertent return to the parked position during operation.

The total range of movement between the base 104 and upper assembly 102 may be restricted by travel stops (not shown) formed by other surfaces of the base 104 and upper housing 102, located remotely from the lock assembly, that prevent unwanted excessive relative rotation, as known in the art. Alternatively, interaction between the pin 804 and the post extension 602*b* may provide travel stops to limit the range of rotation.

A lock assembly such as the one described above may be provided at one or both pivot posts 602. Providing two lock assemblies will increase the amount of force necessary to lean the upper assembly 102 back against the bias of the locking pins 804. The total amount of force to lean the upper assembly 102 also may be modified by adjusting the spring constant of the spring 808, changing the angles of the detent 802 and pin 804, and so on. The foregoing arrangement may be modified by removing the ramped shape between the detent 802 and the end of the pin 804, which will require some external force to push the pin 804 back to unlock the parts. In other embodiments, the foregoing arrangement may be replaced by a conventional locking pin that is operated by a user's foot or hand. These and other embodiments will be understood by the person of ordinary skill in the art in view of the present disclosure.

Figure 8B:
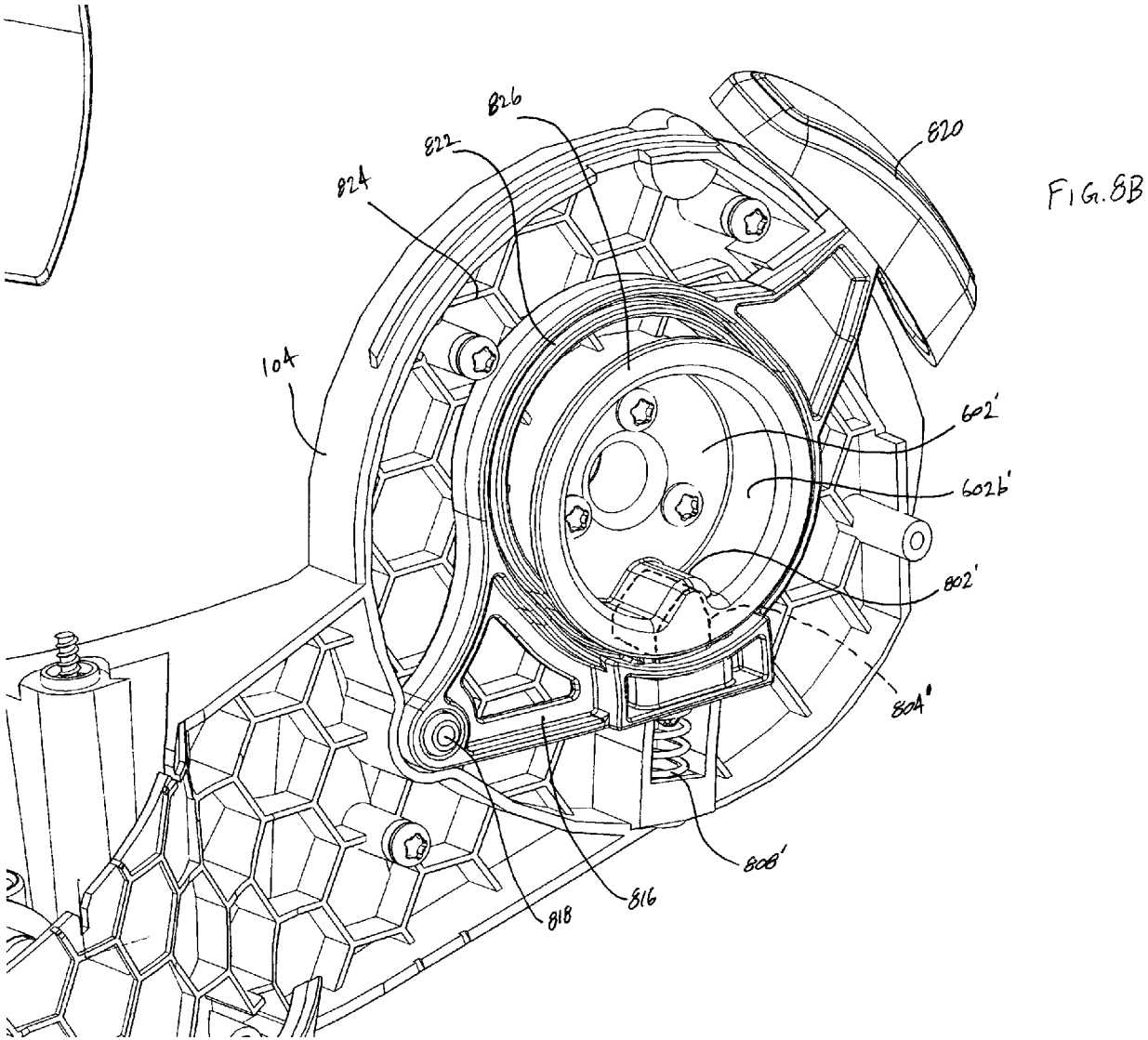
FIG. 8B is a side view of an alternative exemplary pivot lock arrangement.

FIG. 8B illustrates an exemplary alternative embodiment of a pivot lock mechanism. In this embodiment, the pivot post 602' includes a detent 802' formed in a generally cylindrical extension 602*b*'. A lock lever 816 is movably mounted to the base 104, and includes a retainer pin 804' that fits into the detent 802' when the lever is in one position (shown), and clears the detent 802' when the lever 816 is in a displaced position. A spring 808' biases the lever 816 and pin 804' into the locked position. In the illustrated embodiment, the retainer pin 804' is rigidly formed with the lever 816, but a movable connection may be provided between these parts, or they may be joined by a spring or pushrod or other mechanism.

The lever 816 in the exemplary embodiment is pivotally mounted to the base 104 by a lever pivot 818 located on one side of the pivot post 602', and extends to a pedal 820 located on another side of the pivot post 602'. The pedal 820 preferably is the only part of the locking mechanism that is exposed to the user, which may be accomplished by extending the pedal 820 through an opening through a housing covering the base 104. The lever 816 may include a pivot track 822 formed adjacent the pivot post 602'. The track 822 may be located between a wall 824 of the base 104 and a flared out portion 826 of the pivot post extension 604*b*', and provided with sufficient clearance to generally move freely therebetween. The pivot track 822 may help align the lever 816, and may provide structural support to prevent the lever 816 from buckling laterally when a user applies pressure on the pedal 820. A travel stop may also be provided to prevent the lever 816 from moving too far in either direction.

In other embodiments, different locking mechanisms or part arrangements may be used.

For example, the lever pivot 818 and/or pedal 820 may be located elsewhere, and the pivot track may 822 be omitted or modified (to form an incomplete loop, for example). Other variations will be readily apparent to persons of ordinary skill in the art in view of the present disclosure.

Figure 9:
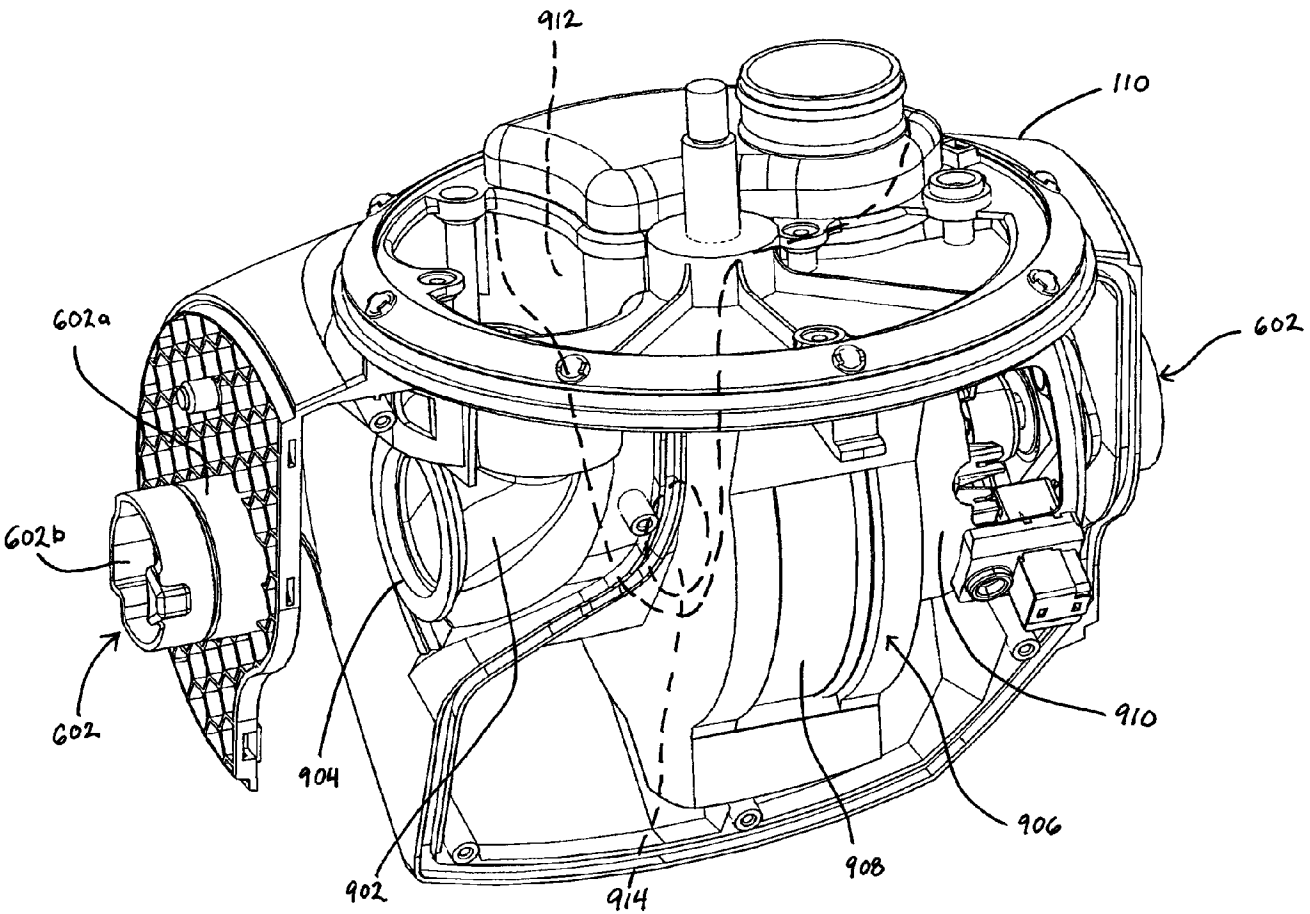
FIG. 9 is a perspective view of an exemplary motor housing for a cleaning device shown with various parts removed.

Referring to FIGS. 5 and 9, the base 104 may be fluidly connected to the motor housing 110 by a connection hose 510. The connection hose 510 may comprise a rigid pipe that is mounted to the base 104, with an inlet 512 of the hose 510 located in fluid communication with the inlet nozzle 502, and an outlet 514 of the hose 510 in fluid communication with an inlet 904 to a first air passage 902 through the motor housing 110. The junction between the connection hose outlet 514 and the first air passage inlet 904 may be aligned with the axis of rotation between the base 104 and upper assembly 102, so that rotation of the base 104 relative to the upper housing 102 does not interfere with fluid flow between these parts. The connection hose 510 may be sealed to the first motor housing passage 902 by forming the parts with surrounding flanges or labyrinthine seals, and by including any suitable rotating seal arrangement. For example, in the shown embodiment, the connection hose outlet 514 includes an inner protrusion 516 that first inside an inner diameter of the first motor housing passage inlet 904, and an outer flange 518 that fits around the first motor housing passage inlet 904. These structures help prevent air from entering at this junction. In addition, a seal, such as a rubber or felt ring (not shown) may be captured between the inner protrusion 516 and outer flange 518 to help inhibit air leaks into these passages. It should also be recognized that it may be desirable to allow some air leakage through this junction to prevent damage to the motor if airflow is obstructed upstream of the junction (e.g., if the inlet nozzle 502 or connection hose 510 becomes blocked). It will also be appreciated that other constructions, such as a flexible hose, may be used to fluidly join the base 104 to the motor housing 110. Such a flexible hose may extend all the way to a rotatable handle, such as described below, and may supplant a separate hose (e.g., hose 1808) that joins the intermediate motor housing to a rotating handle. In addition, the first motor housing passage 902 may be omitted entirely in other embodiments.

Still referring to FIG. 9, a fan/motor 906 is mounted in the motor housing 110 by rubber bushings or other mounting structures known in the art. The shown fan/motor includes a fan 908 that is driven by an electric motor 910, as conventionally known. The motor housing 110 includes two air passages. The first air passage 902, discussed before, conveys air from the base 104 to the upper assembly 102, and thence to the dirt collector 108 where dirt is separated from the airflow. A second air passage 912 conveys cleaned air from dirt collector 108 to a fan inlet 914. The air passages to and from the dirt collector 108 may comprise a conventional arrangement, but in one exemplary embodiment, these air passages are adapted to permit rotation of the dirt collector relative to the motor housing 110.

Figure 4:
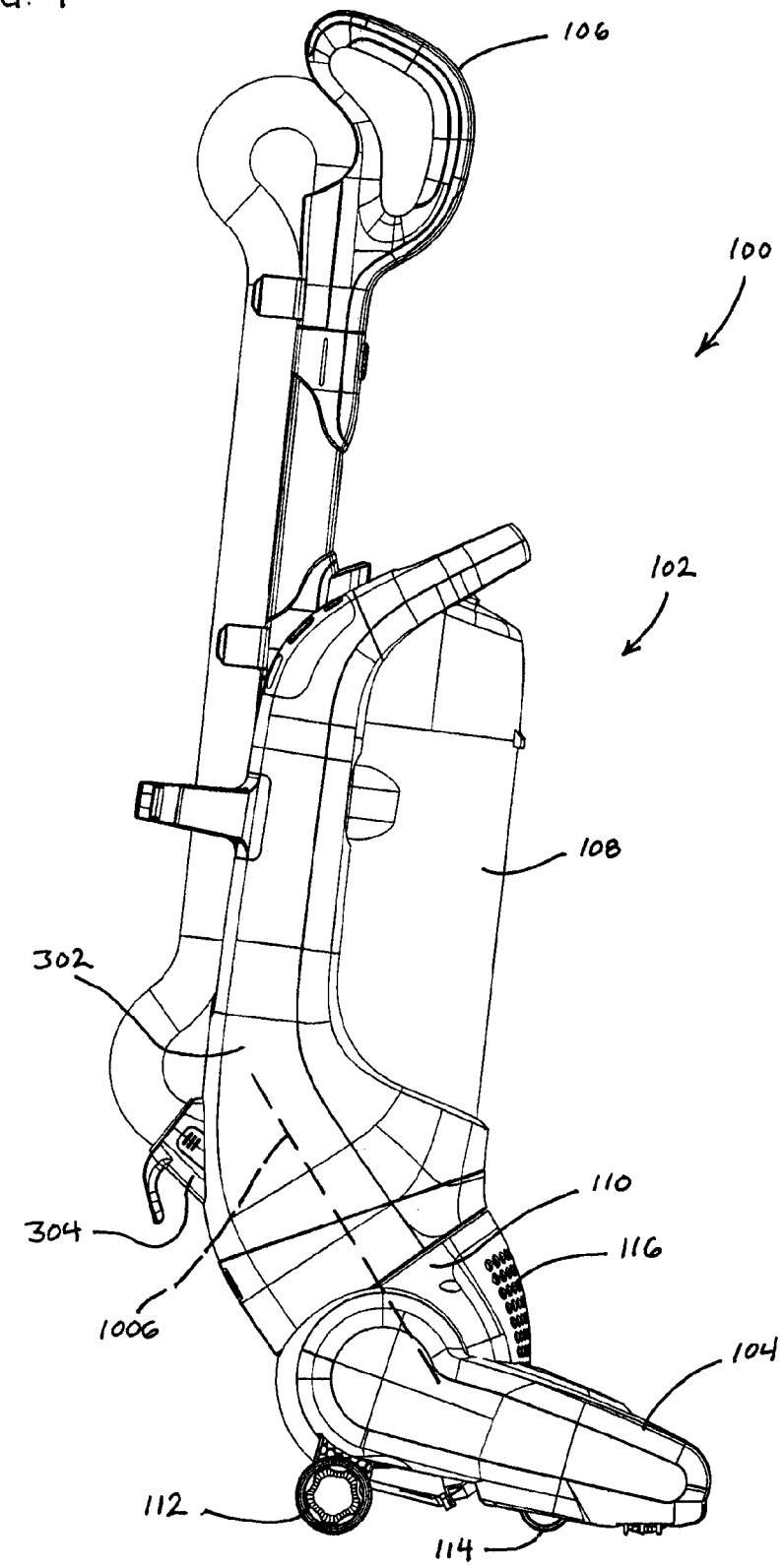
FIG. 4 is a right side elevation view of the exemplary cleaning device of FIG. 1.
Figure 10:
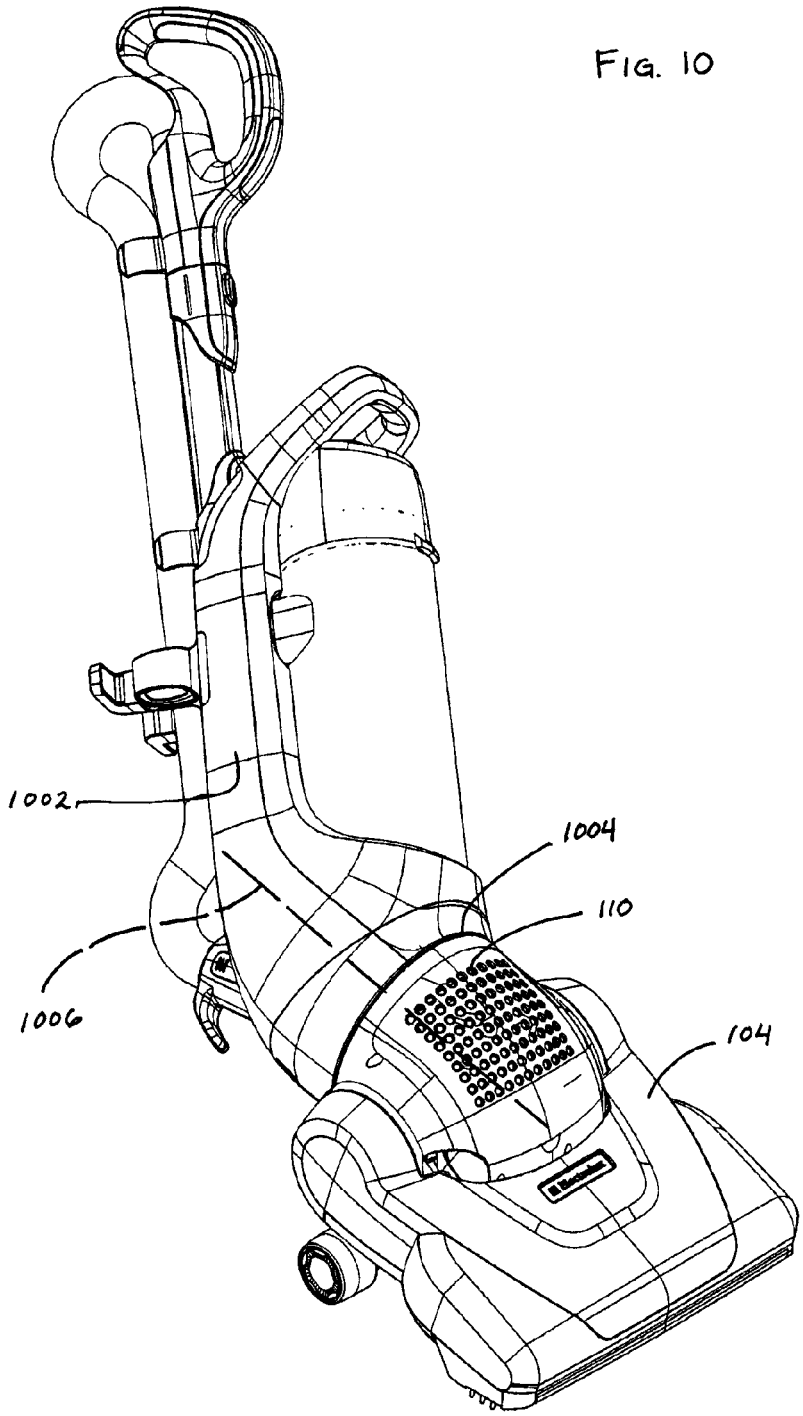
FIG. 10 is a perspective view of an exemplary cleaning device shown with a rotating handle in a rotated and leaned back position.
Figure 11:
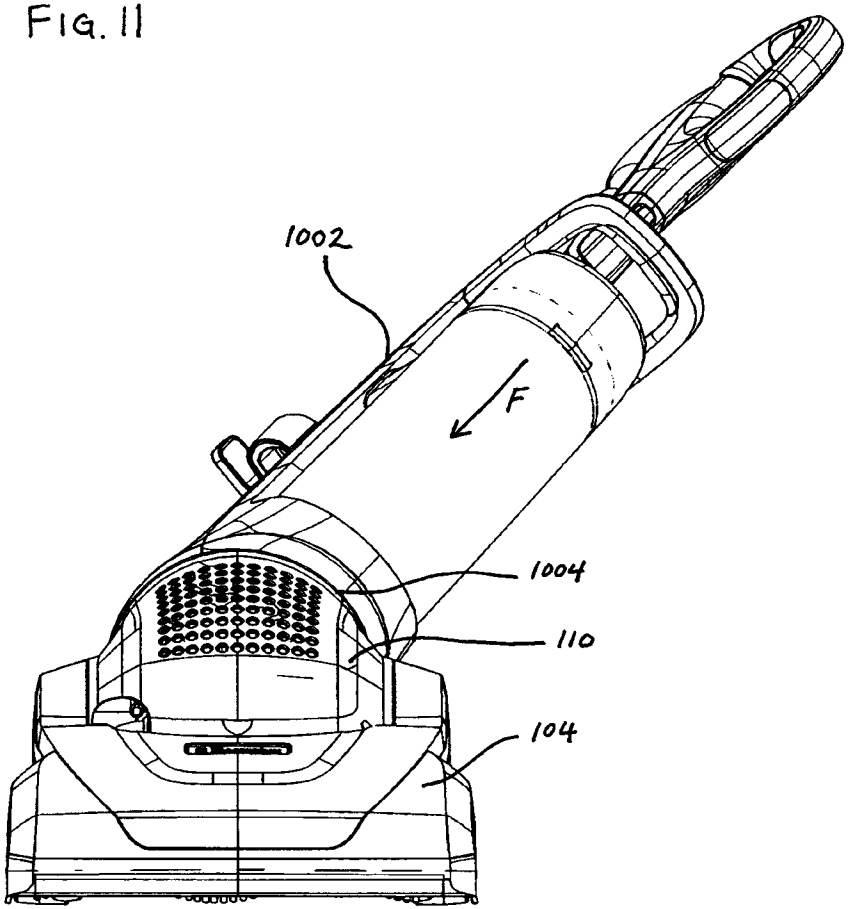
FIG. 11 is a front elevation view of the illustration of FIG. 10.
Figure 12:
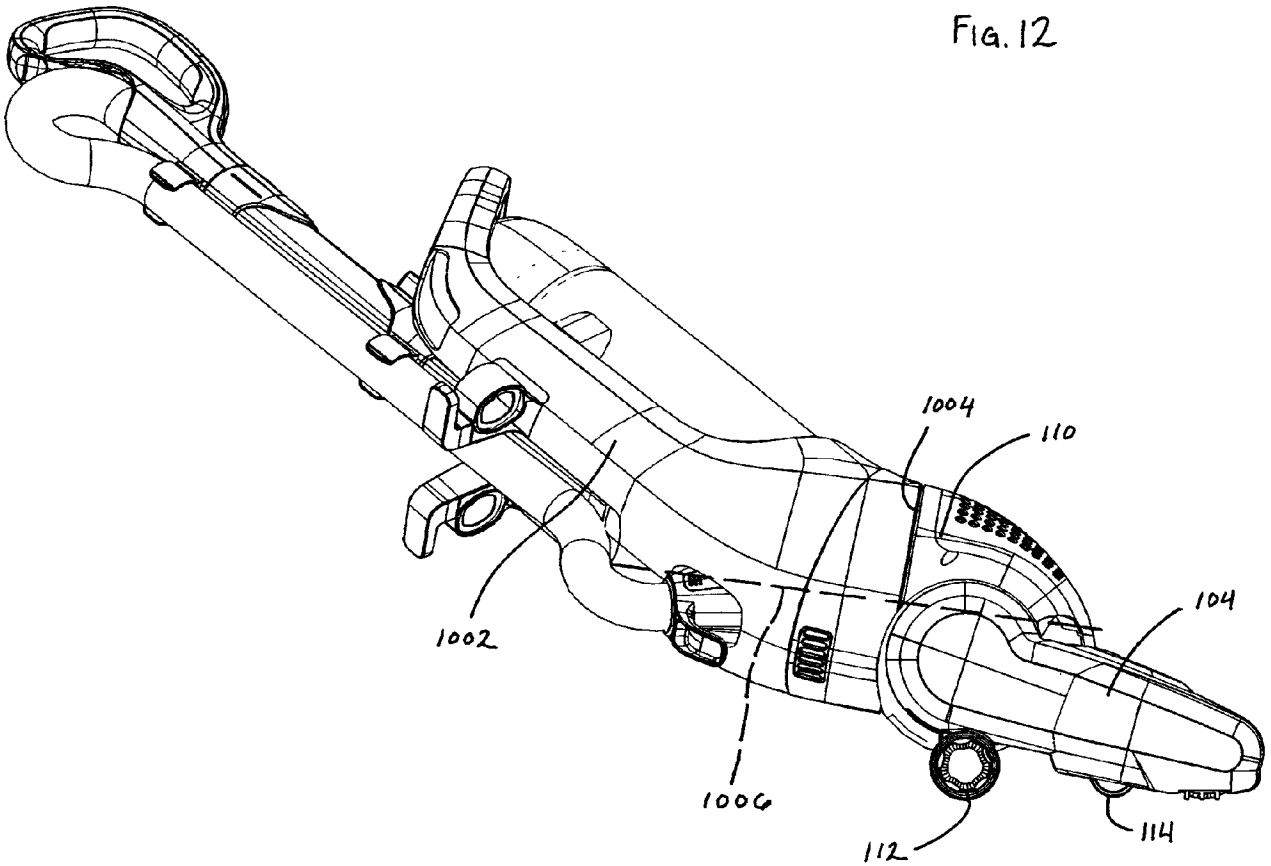
FIG. 12 is a side elevation view of the illustration of FIG. 10.

Referring now to FIGS. 10-12, in one embodiment, the upper assembly 102 may comprise an upper rotating handle 1002 that rotates with respect to the motor housing 110. FIGS. 10-12 illustrate the upper assembly 102 leaned back and rotated to the left with respect to the fore-aft direction. In the shown embodiment, the rotating handle 1002 is connected to the motor housing 110 at a pivot joint 1004 that permits rotation about a handle pivot axis 1006 that lies in a longitudinal plane defined by the fore-aft and vertical directions (Arrows A and C in FIG. 1). The orientation of the handle pivot axis 1006 changes as the motor housing 110 is leaned back relative to the base 104 about the previously-described base pivot axis 118. As shown in FIG. 4, the handle pivot axis 1006 may be angled back from the true vertical direction (i.e., perpendicular to a floor) by about 20 to 45 degrees when the upper assembly 102 is in the upright position. The difference between the handle pivot axis 1006 and the vertical direction may increase as the upper assembly 102 is tilted backwards about the base pivot axis 118. For example, as shown in FIG. 12, the handle pivot axis 1006 may be angled back by about 80-90 degrees or more relative to the vertical direction when the upper assembly 102 is in the fully-inclined operating position. It will be appreciated that the exact inclination angle may vary if the front wheels 114 are raised or lowered relative to the base 104 to change the height of the inlet nozzle 502.

The rotating handle 1002 may be rotated by a torque applied by the operator through the grip 106. Rotation about the handle pivot axis 1006 works in conjunction with rotation about the base pivot axis 118 to provide the cleaning device 100 with increased maneuverability. For example, during straight forward movement, the operator applies a force to the grip 106 that passes down the upper assembly 102 to the base 104. This force drives the base 104 forward on the wheels 112, 114. If the operator then applies a torque to rotate the rotating handle 1002 to one side, the driving force—shown by Arrow F in FIG. 11—assumes an angle with respect to the wheels 112, 114. The tendency of the base 104 is to move in the direction of the wheels 112, 114, and therefore this angled force F tends to drive the base 104 in line with the wheels 112, 114. Thus, rotating the rotating handle 1002 converts at least a portion of the forward movement force into a lateral movement of the base 104. In essence, twisting the rotating handle 1002 about the handle pivot axis 1006 steers the vacuum cleaner. Rotation of the rotating handle 1002 about the motor housing 110 may be independent of rotation of the motor housing 110 about the base 104, but a linkage between the two rotating joints may be provided to provide some predefined association between these movements.

It has been found that the foregoing steering action allows the user to control the movement of the cleaning head 110 across the cleaning surface with greater ease than in conventional designs. For example, a twist to the handle in a leftward direction (counterclockwise as viewed from the operator's perspective) will steer the base 104 to the left, and vice-versa. This added maneuverability helps the operator avoid obstacles and move the vacuum to dirt floor areas with greater ease.

In the foregoing embodiment, the motor housing 110 moves with respect to the base 104 about a single axis (the base pivot axis 118), and the rotating handle 1002 moves with respect to the base 104 about two axes (the base pivot axis 118 and the handle pivot axis 1006). The motor housing 110 provides an intermediate link between these two pivot axes. In other embodiments, this intermediate link may be provided by other structures that do not include a motor housing. For example, the fan/motor may be moved to the base 104, and the motor housing may comprise air passages that join the rotating handle 1002 to the base 104. As another example, the fan/motor may be moved to the rotating handle 1002. As yet another example, the dirt collector 108 or other parts may be moved into the intermediate link joining the two pivot axes. These and other embodiments will be understood by persons of ordinary skill in the art in view of the present disclosure.

Rotation between the upper portion 1002 of the upper assembly 102 and the motor housing 110 may be facilitated by a variety of structures. In the prior art, such as in U.S. Pat. No. 5,584,095 and U.S. Publication No. 2009/0056065, it was known to use existing air passageways to form a pivot axis between the vacuum cleaner grip and the base. In the former reference, the combined pivot/air passage comprises a motor exhaust outlet pipe, and in the latter reference the combined pivot/air passage comprises concentric dirt and clean air flow pipes. One problem with these arrangements is that the pivot itself must be sealed to prevent air flow leaks into the or out of the pipes. This leads to more complex designs, and subjects the pivot and its seals to dirt and debris that pass through the pipes. Other devices, such as the device shown in U.S. Publication No. 2008/0040883, disassociate the air passage from the pivot mechanisms, but these devices typically are not suited to orient the handle pivot axis along the length of the handle (the pivot axis is perpendicular to the handle's length), and include only a single air passage which requires either the fan/motor to be above the pivots, or the device to operate with the fan/motor in the dirty air stream (i.e., upstream of the dirt collector). These compromises have various detriments. For example, locating the fan/motor above the pivots can make the device top-heavy, and placing the fan in the dirty air subjects it to greater wear and tear and delivering dirty air to the dirt collector under pressure (instead of under a vacuum) causes more dirt to escape the system if a leak develops.

To address the shortcomings of the prior art, one embodiment may use a pivot structure that connects the motor housing 110 to the rotating handle 1002 independently of the airflow passages, while still permitting multiple airflow passages to exist between the motor housing 100 and the rotating handle 1002. One exemplary pivot structure is shown in exploded view in FIG. 13, and in part in a cross-section view in FIG. 14. In this embodiment, the motor housing 110 includes a generally disk-shaped bearing interface region 1302 with a pivot pin 1304 extending from a center of the interface region 1302. The pivot pin 1304 may be captured or cast in place, bolted, or otherwise connected to the motor housing 110 to provide a firm connection that will withstand the rigors of use. In the shown embodiment, the pivot pin 1304 comprises an enlarged lower end 1402 (FIG. 14) that is contained within a cylindrical boss 1306 formed in the motor housing 110. A post 1308 extends upwards from the enlarged lower end 1402, and terminates at a threaded end 1310.

A lower bearing race 1312 is attached to the interface region 1302 to surround the pivot pin 1304. The bearing race 1312 includes a smooth perimeter surface 1314 on which a set of bearings 1316, such as the shown ball bearings, can roll. The lower bearing race 1312 may, optionally, conveniently be formed with other structures, such as a portion of the second air passage 912 through the motor housing 110. The ball bearings 1316 are contained by a bearing cage 1318, which has a number of holes 1320 in which the bearings 1316 loosely fit to maintain their angular spacing around the pivot pin 1304. The bearing cage 1318 preferably does not contact parts other than the ball bearings 1316 to minimize friction. An upper bearing race 1322 fits over the lower bearing race 1312 and includes a corresponding smooth perimeter surface on which the ball bearings 1316 can roll. The upper bearing race 1322 captures the ball bearings 1316 and bearing cage 1318 in place against the lower bearing race 1312, and together these parts form a rotating bearing system.

Figure 13:
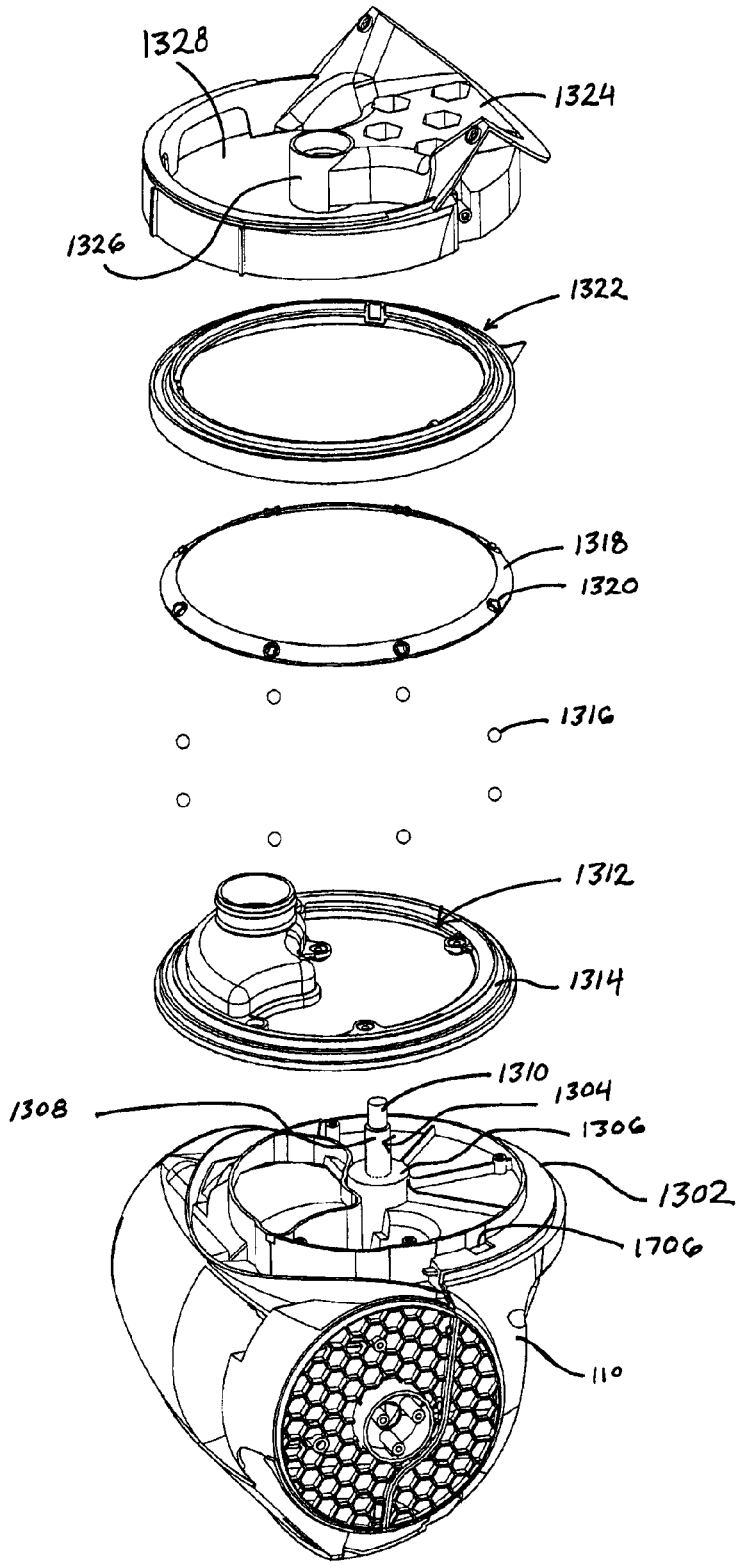
FIG. 13 is an exploded view of an exemplary embodiment of a rotating handle pivot joint.
Figure 14:
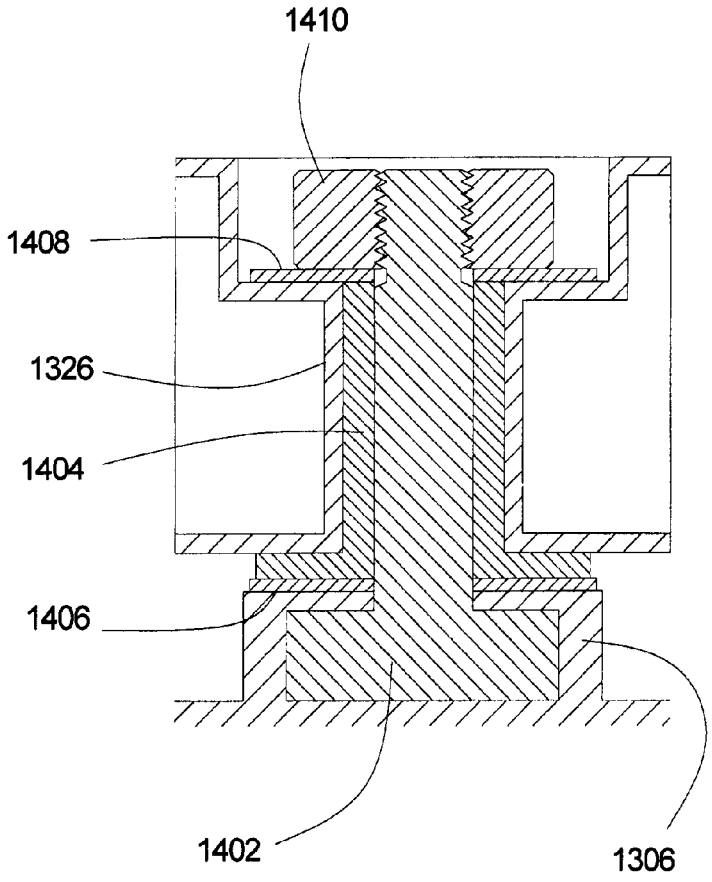
FIG. 14 is a cross-sectional view of the pivot pin portion of the exemplary joint illustrated in FIG. 13.

The upper bearing race 1322 is rigidly attached to the rotating handle 1002 of the upper assembly 102 by any suitable means, such as screws, snap-fitment, or the like. In the shown embodiment, the upper bearing race 1322 is connected to the bottom of a pivot mount 1324 that forms the lowermost structural portion of the rotating handle 1002. As shown in FIGS. 13 and 14, the pivot mount 1324 includes a central boss 1326 that fits over the pivot pin 1304, and an opening 1328 located adjacent the central boss 1326 to receive air flow hoses described elsewhere herein. A bearing sleeve 1404 may be provided between the central boss 1326 and the pivot pin 1304. A nut 1410 is threaded to the end 1310 of the pivot pin 1304, and washers 1406, 1408 may be located between the nut 1410 and the bearing sleeve 1404, and between the bearing sleeve 1404 and the cylindrical boss 1306 formed on the motor housing 110. With this arrangement, the pivot pin 1304, bearing sleeve 1404 and washers 1406, 1408 may be dimensioned and made from suitable materials to firmly connect the parts while still permitting rotation. For example, the pivot pin 1304 and washers 1406, 1408 may be steel, and the bearing sleeve 1404 may be brass or another material that can move freely on the steel without binding. Any suitable lubrication or friction-reducing materials may be added to the parts, as necessary to ensure long life and reduce binding or friction. Also, the bearing sleeve may be long enough that the upper washer 1408 presses against it firmly under pressure from the nut 1410, while applying relatively moderate or low force against the center boss to prevent binding at this point.

When the parts are connected as shown in FIG. 14, the rotating handle 1002 is firmly connected to the motor housing 110 by the nut 1410, and the ball bearings 1316 provide rotating support between the parts at a location near their outer perimeter. Locating the bearing surface away from the pivot axis formed by the pivot pin 1304 improves the assembly's ability to resist bending forces and may reduce the necessity to form the parts from thicker or more robust materials. As explained below, the foregoing arrangement also permits air passages to pass within the perimeter of the outer bearing between the rotating handle 1002 and the motor housing 110.

It will be appreciated that the foregoing connection and bearing arrangement may be modified in various ways as desired, or as suggested by the particular application. For example, the pivot pin 1304 and central boss 1326 may be robust enough that the ball bearings 1316 may be omitted. As another example, the pivot pin 1304 may be omitted and replaced by other devices to hold the rotating handle 1002 to the motor housing. For example, a series of ball bearings with their rotating axes pointed towards the radial center of the ring of ball bearings 1316 may be provided to clamp the upper bearing race 1322 down against the ball bearings 1316. As another example, the ball bearings 1316 may be replaced by roller bearings or low-friction surfaces, such as polytetrafluoroethylene rings. In addition, travel stops, such as protrusions on the upper and lower bearing races 1322, 1312 that contact one another, may be used to prevent excessive handle rotation. Other arrangements and variations will be apparent to persons of ordinary skill in the art in view of the present disclosure.

Figure 17:
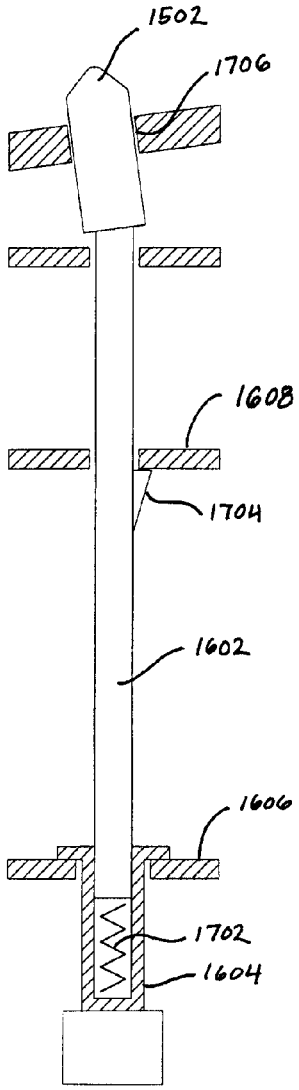
FIG. 17 is a cutaway side view of an exemplary pivot lock arrangement for a rotating handle pivot.
Figure 15:
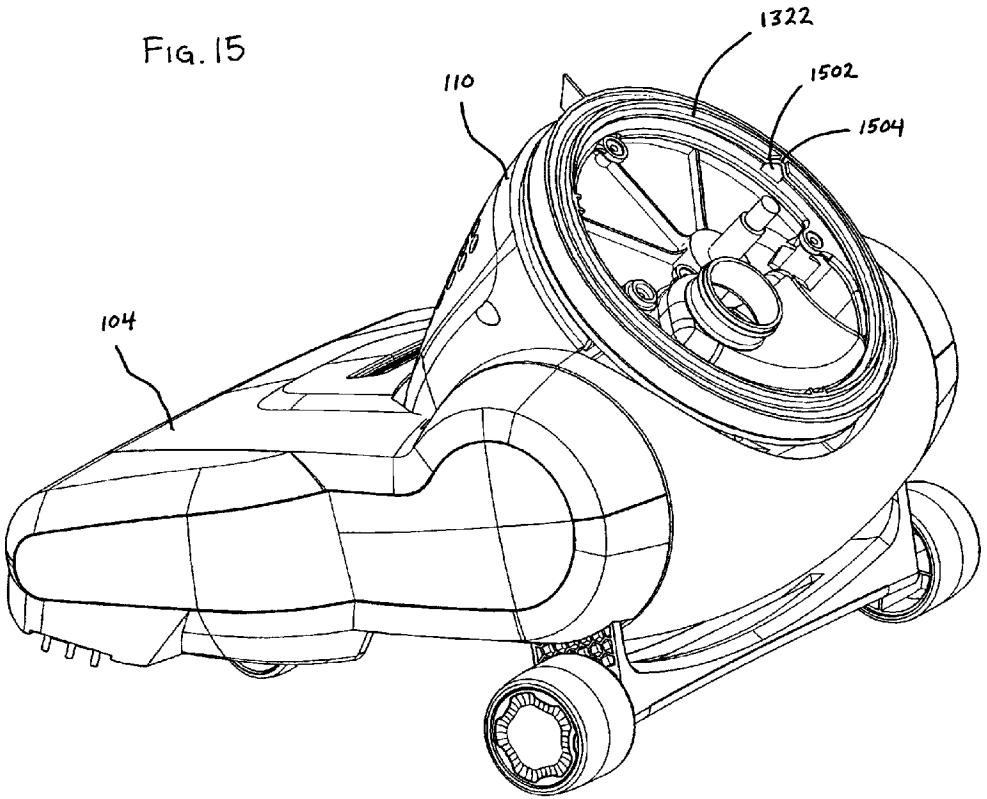
FIG. 15 is an isometric view of an exemplary embodiment of a pivot lock arrangement for a rotating handle pivot.
Figure 16:
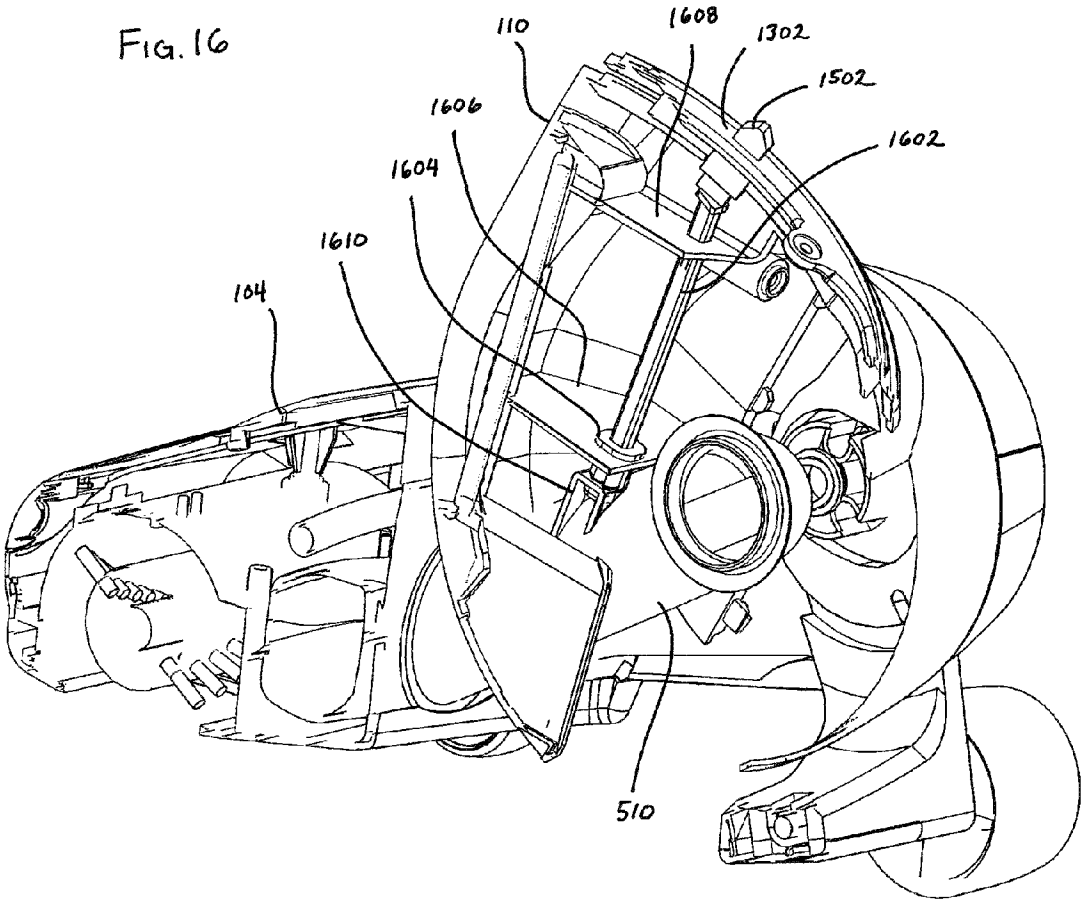
FIG. 16 is a cutaway view of an exemplary motor housing and base embodying an exemplary pivot lock arrangement for a rotating handle pivot.

If desired, a rotation lock may be used to prevent unwanted rotation of the rotating handle 1002 relative to the motor housing 110. An example of a rotation lock is shown in FIGS. 15-17. FIG. 15 illustrates the base 104 and motor housing 110, and only the upper bearing race 1322 of the rotating handle 1002 shown. The exemplary rotation lock may include a locking pin 1502 that fits into a correspondingly-shaped detent 1504 on the upper bearing race 1322. The locking pin 1502 is slideably mounted in a passage 1706 through the bearing interface region 1302 of the motor housing. The detent 1504 preferably is located adjacent the smooth surface upon which the bearings 1316 roll. The locking pin 1502 may be moved into the detent 1504 by any suitable mechanism to retain the rotating handle 1002 in a fixed "parked" location relative to the motor housing 110. If desired, more than one detent 1504 or locking pin 1502 may be provided, to provide multiple park locations, or to increase the retaining force.

As shown in FIGS. 16 and 17, the exemplary locking pin 1502 is biased into the locking position by a pushrod 1602. The lower end of the pushrod 1602 fits in a cup 1604 that is retained in an opening through a flange 1606 in the motor housing 110. The cup 1604 is free to move up and down in this opening, but the parts are dimensioned to prevent complete removal of the cup 1604 during normal use. A spring 1702 is located in the cup 1604 to bias the pushrod 1602 towards the upper bearing race 1322. Upward movement of the pushrod 1602 may be restricted by a protrusion 1704 that contacts another flange 1608 through which the pushrod 1602 passes.

The cup 1604 is positioned adjacent a protrusion 1610 that extends from the base 104. In this example, the protrusion 1610 extends from the connection hose 510, but other locations are possible. When the motor housing 110 is pivoted forward, the cup 1604 contacts the protrusion 1610, and moves it upwards relative to the cup mounting flange 1606. This upward movement generates a force against the spring 1702, which is applied to the bottom of the pushrod 1602 to drive the locking pin 1502 upwards into the detent 1504. The spring 1702 preferably is dimensioned to such that it does not fully compress in the event the locking pin 1502 is not aligned with the detent 1504 when the motor housing 110 is pivoted upwards. This allows the upper assembly 102 to be pivoted upwards regardless of the rotating handle's orientation, and the rotating handle 1002 preferably then can be rotated to the parked position at which time the locking pin 1502 will engage the detent 1504.

The locking pin 1502 may be tapered, such as shown, so that an operator can defeat the locking engagement even when the upper assembly 102 is in the parked position. Thus, with sufficient effort, the operator can rotate the rotating handle 1002 about the motor housing 110 to drive the locking pin 1502 out of engagement with the detent 1504. Alternatively, the locking pin 1502 may be squared off or otherwise shaped such that it can not be disengaged without leaning the upper assembly 102 back to relieve the pressure applied by the spring 1702.

The foregoing exemplary rotation lock may be modified in any suitable way in other embodiments. For example, the rotation lock may be located remotely from the bearing race 1322, or it may be operated manually instead of by rotation of the upper assembly 102 relative to the base 104. Other variations will be apparent to persons of ordinary skill in the art in view of the present disclosure.

As explained above, the motor housing 110 may include first and second air passages 902, 912 to convey airflow through the cleaning device 100. The first air passage 902 conveys dirt-laden air from the base 104 to the dirt collector 108, and the second air passage 912 conveys cleaned air from the dirt collector 108 to the fan/motor 906. In the exemplary embodiment, the dirt collector 108 may be mounted in the rotating handle 1002. As such accommodations may be made to permit air to flow from the first and second air passages 902, 912 to the dirt collector 108 regardless of the angular orientation of the rotating handle 1002 relative to the motor housing 100. While combined pivots/air passages may be used in some embodiments, the illustrated exemplary embodiment uses a pair of flexible hoses to convey air to and from the dirt collector 108. One embodiment of such an arrangement is now described with respect to FIGS. 6 and 18.

Figure 18:
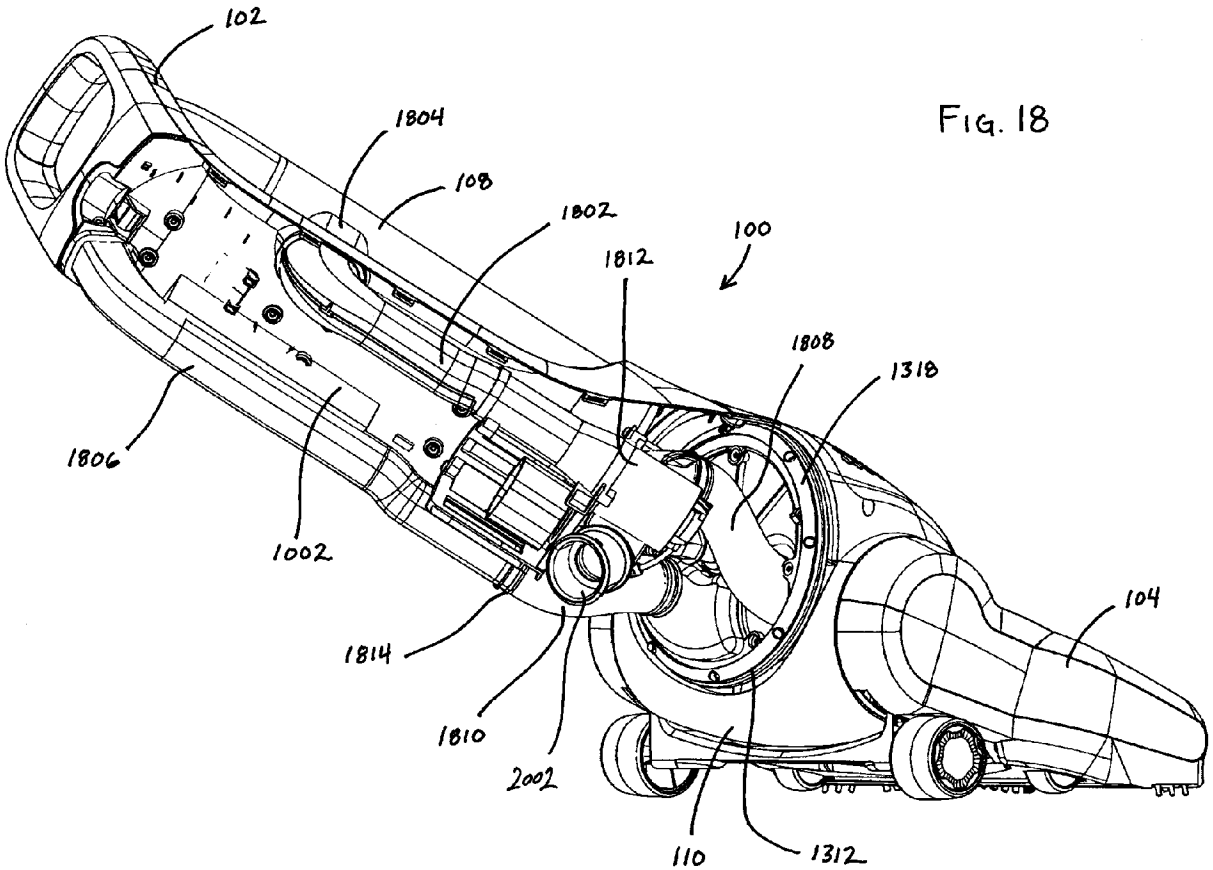
FIG. 18 is a rear perspective view of cleaning device incorporating an exemplary rotating handle and airflow hose arrangement, shown with various parts removed.

FIG. 18 illustrates the cleaning device 100 with the grip 106 and various parts of the upper assembly 102 removed for illustration. The upper assembly 102 is leaned back relative to the base 104, and the rotating handle 1002 is rotated relative to the motor housing 110. The dirt collector 108 is mounted on the front of the rotating handle 1002. A first rigid pipe 1802 leads to a dirt collector inlet 1804, and a second rigid pipe 1806 leads from a dirt collector outlet. A first flexible hose 1808 joins the first motor housing air passage 902 to the first rigid pipe 1802, and a second flexible hose 1810 joins the second motor housing air passage 912 to the second rigid pipe 1806. As shown, the first and second flexible hoses 1808, 1810 are located generally within the perimeter of the lower and upper bearing races 1312, 1322, but are offset from the handle pivot axis 1006. The first and second flexible hoses 1808, 1810 also may be completely contained and concealed within a rigid outer housing 302 (FIGS. 3 and 4) of the upper assembly 102. This provides both a compact and aesthetically-pleasing arrangement, and minimizes the likelihood that the hoses 1808, 1810 can be entangled or damaged during normal use. If desired, the outer housing 302 may be removable (or provided with a removable or openable panel) to permit cleaning of the flexible hoses 1808, 1810.

At the motor housing 110, the first flexible hose 1808 is connected to a first mounting flange 604 located at the end of the first air passage 902. The first mounting flange 604 may be located in a recess 606, the purpose of which is described subsequently herein. The second flexible hose 1810 is connected to a second mounting flange 608 located at the end of the second air passage 912. As noted above, a portion of the second air passage 912 may conveniently be constructed integrally with the lower bearing race 1312, but this is not required. At the rotating handle 1002, the first flexible hose 1808 may be connected to a valve body 1812, and the second flexible hose 1810 may be connected to an end of the second rigid tube 1806.

The locations, lengths and shapes of the first and second flexible hoses 1808, 1810 are selected to permit free rotation of the rotating handle 1002 through its desired range of movement without substantial risk of fatigue failure or pinching. The first and second flexible hoses 1808, 1810 may be generally parallel with the handle pivot axis 1006 when the handle 1002 is in a neutral position (i.e., not turned left or right relative to the motor housing 110), or at some other rotational orientation 1002 of the handle relative to the motor housing 110. As shown in FIG. 18, the first and second flexible hoses 1808, 1810 flex to accommodate handle rotation, but may still extend along axes that do not intersect the handle pivot axis 1006 (the direction of extension being the direction from one end of each hose 1808, 1810 to the other end of the same hose, without regard to intermediate variations in the hose's shape).

In the exemplary embodiment, the valve body 1812 displaces the end of the first flexible hose 1808 closer to the motor housing 110 as compared to the second flexible hose 1810, leading to the use of the recess 606 to increase the total length of the first flexible hose 1808. Of course, this arrangement is exemplary and need not be provided in other embodiments. One or both of the flexible hoses 1808, 1810 may be round, oval, or any other suitable shape. It may be desirable to use oval shapes, with the long axis of the oval oriented generally in the major direction of flexure (generally tangential to handle pivot axis 1006, or at least not aligned radially with the handle pivot axis 1006), to prevent the hoses from pinching down too much when they are flexed.

The desired shape, length and cross-sectional profile of the hoses 1808, 1810 may vary depending on various factors. For example, if a greater amount of rotation is desired between the rotating handle 1002 and the motor housing 110, the hoses should be made of a more flexible material or be longer to provide greater flexibility. If the hoses are further from the handle pivot axis 1006, they also may need more flexibility as increased radial distance from the pivot axis requires greater displacement for a given amount of rotation. If the hoses are relatively close to the pivot axis, it may be desirable to make them with a smaller diameter due to less space being available at closer distances. Alternatively, the hoses could be given a cross section with a long direction extending radially from the pivot axis, provided excessive pinching is not a concern. Other variations based on the particular details of the application will be apparent to persons of ordinary skill in the art in view of the present disclosure.

The flexible hoses 1808, 1810 may comprise any suitable durable, flexible material and construction. If desired, the hoses 1808, 1810 may be blowmolded, or may include integral, internal or external reinforcements, such as a wire wrap. One suitable material may be polyethylene ("PE"), and other materials may be incorporated into the tube material. For example, ethylene-vinyl acetate ("EVA") may be added to provide softness, reduce the amount of force required to rotate the assembly, and preserve durability of the material. It should be appreciated that other materials and various combinations of materials may be used. In addition, one or both ends of each hose 1808, 1810 may be swivel mounted to permit the end of the hose to swivel on its mount to the rigid housings. This may reduce fatigue and rotation resistance.

In one example, the hoses 1808, 1810 may comprise smooth or corrugated polypropylene hoses having a diameter of about 46 millimeters (mm) and a length of about 100 mm. It is believed that hoses having the foregoing construction are suitable for a cleaning device 100 in which the rotating handle 1002 pivots about 30 degrees to about 80 degrees or more preferably up to about 65 degrees in either direction from the centered, parked position. Of course, other dimensions and shapes are possible in other embodiments.

In alternative embodiments, the tubes 806 and 808 may comprise concentric flexible hoses or other structures, such as rigid pipes or segments. For example, the tubes may be formed of a material such as polyvinyl chloride ("PVC") and mounted such that the tubes pivot and/or rotate in response to twisting the rotating handle 1002. Such pipes may include telescoping segments and suitable ball-in-socket joints at each end to accommodate the changes in length and orientation that may be necessary for the handle to rotate.

Figure 19:
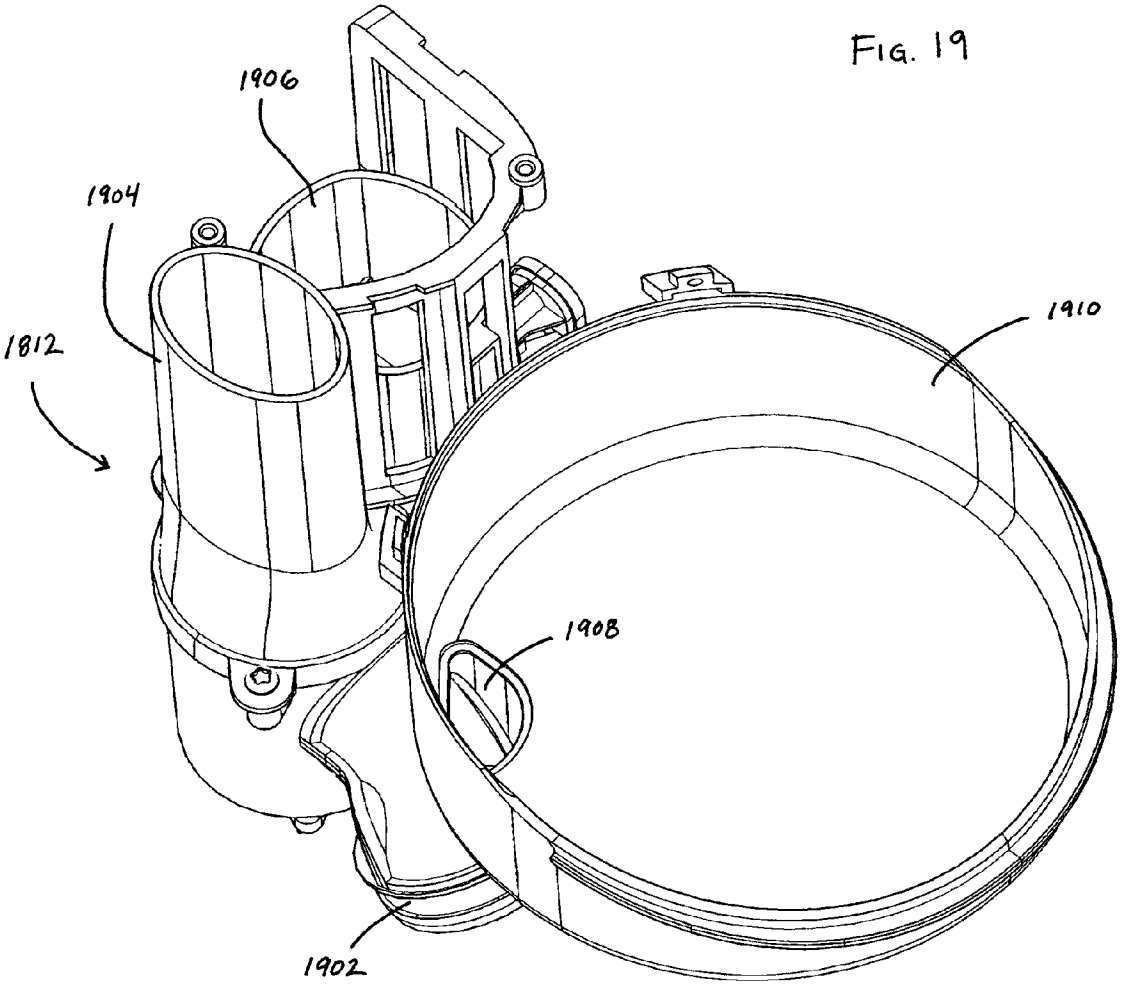
FIG. 19 is an isometric view of an exemplary embodiment of a valve assembly.
Figure 20:
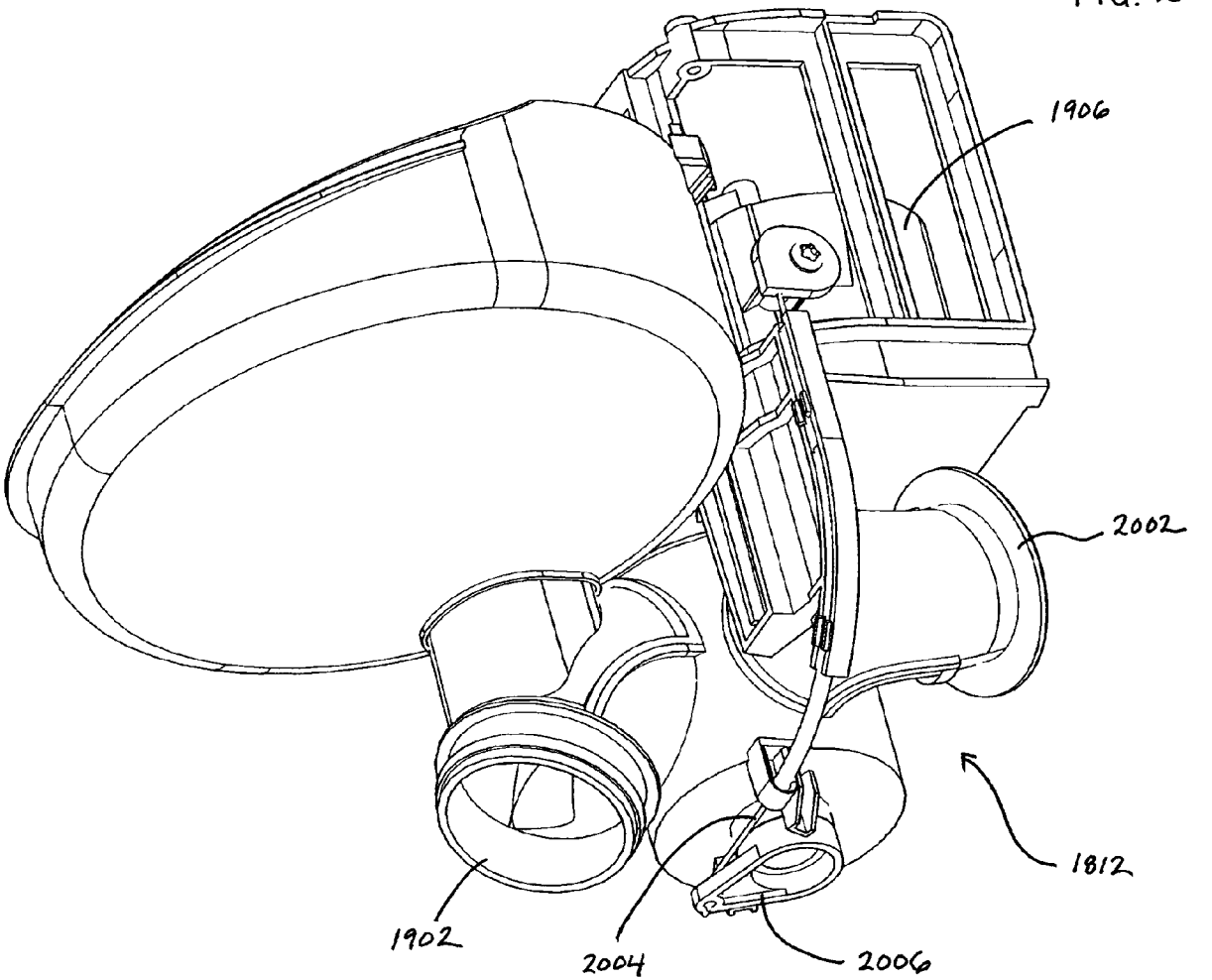
FIG. 20 is an alternate isometric view of the structure of FIG. 19.

FIGS. 19 and 20 illustrate an exemplary embodiment of a valve assembly 1812 that may be used with embodiments of a cleaning device. The valve assembly 1812 is provided to divert airflow to the dirt collector 108 from the floor nozzle 502 to an accessory cleaning tool. Accessory cleaning tools are often provided on vacuum cleaners in the form of a flexible hose that can be used remotely from the main body of the cleaning device. When accessory cleaning tools are provided, it may be desirable to terminate airflow through the flexible hose and tools when they are not in use, to minimize air flow losses in the vacuum cleaner during floor cleaning operations. Accessory tools and hoses, changeover valves, and the like, are well-known in the art. The illustrated exemplary valve assembly 1812 or alternative valve assemblies may be used if it is desired to incorporate an accessory cleaning system into the cleaning device 100.

Figure 2:
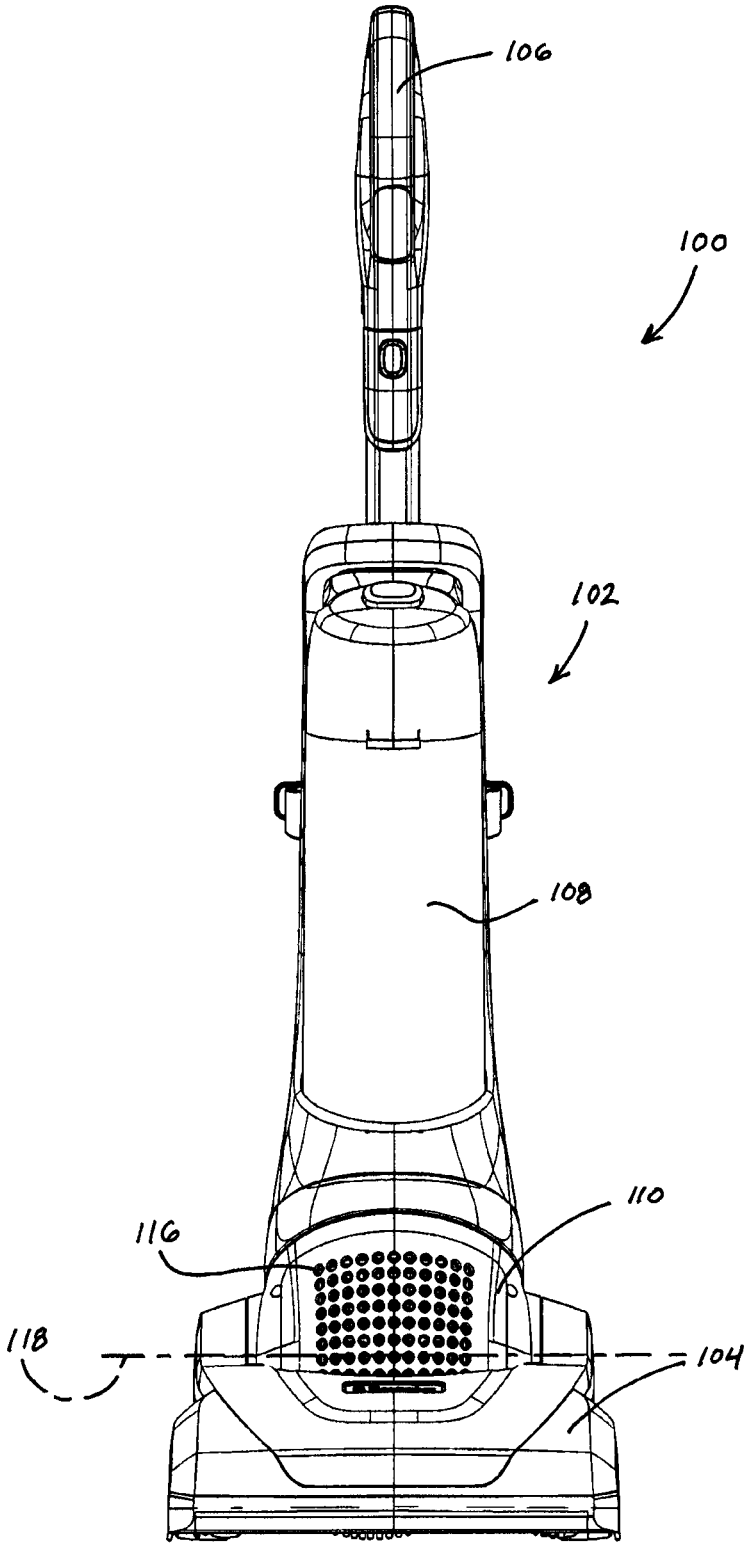
FIG. 2 is a front elevation view of the exemplary cleaning device of FIG. 1.
Figure 3:
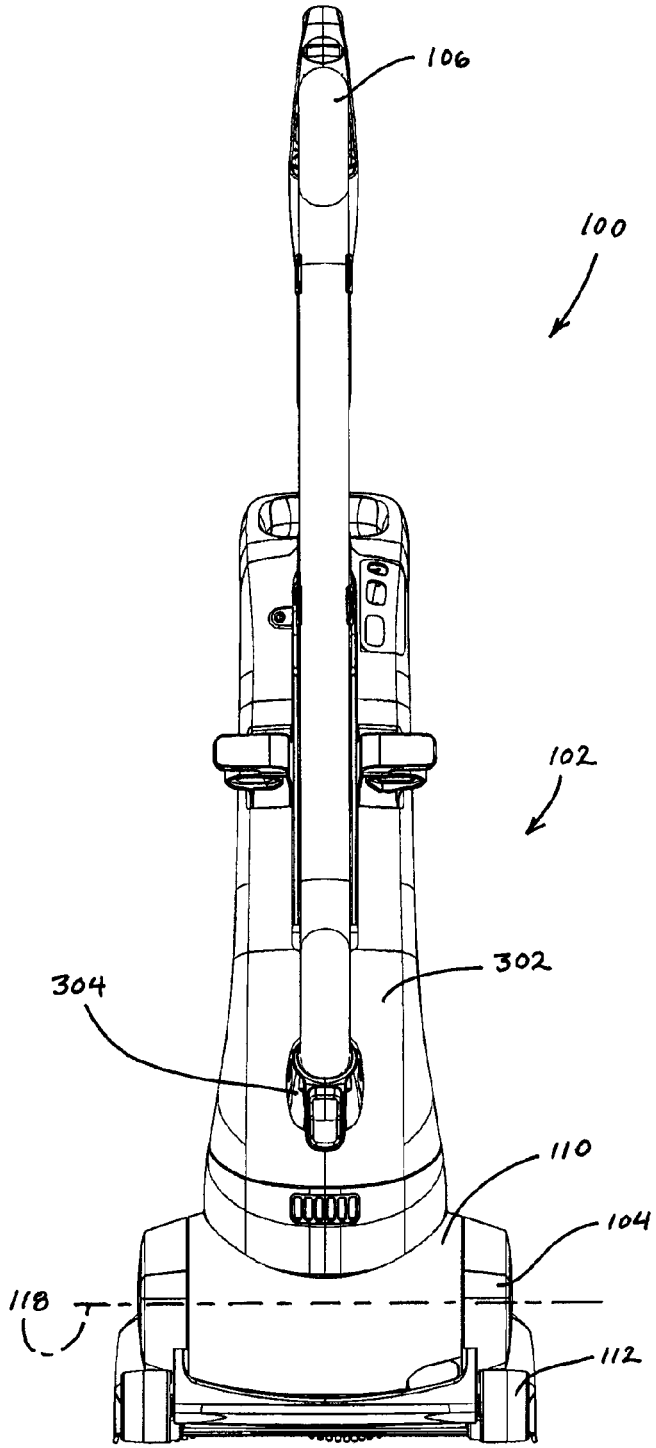
FIG. 3 is a rear elevation view of the exemplary cleaning device of FIG. 1.

The exemplary valve assembly 1812 includes a floor air inlet 1902, an outlet 1904, and an accessory air inlet 2002 (FIG. 2). The accessory air inlet 2002 may be connected to any suitable accessory cleaning system, such as a typical hose and wand. In the exemplary cleaning device 100, the grip 106 may be formed on a removable wand 120 that is connected to the upper assembly 102 by a flexible accessory hose 122. The accessory hose 122 may join the rotating handle 1002 at a hose mount 304 (FIGS. 3 and 4), which is in fluid communication with the accessory inlet 2002. The valve assembly 1812 may be operated automatically or manually, as known in the art. The exemplary valve assembly 1812 is operated by pressing the removable wand 120 into a receiver 1906 mounted on the valve assembly 1812. The receiver 1906 is located at the bottom of a recess into which the wand 120 fits, and is slideable between two operating positions. A spring (not shown) pushes the receiver 1906 upwards when the wand is removed, and the wand 120 pushes the receiver down against the spring when the wand 120 is installed. A stiff cable 2004 connects the receiver 1906 to a valve lever 2006. When the receiver 1906 is pressed down by installing the wand 120, the cable 2004 moves the valve lever 2006 to a floor cleaning position in which the floor inlet 1902 is fluidly connected to the outlet 1904. When the receiver 1906 is lifted by the spring when the wand 120 is removed, the cable 2004 moves the valve lever 2006 to an accessory cleaning position in which the accessory inlet 2002 is fluidly connected to the outlet 1904. Any suitable valve may be located in the valve 1812 to provide the desired fluid flow path changes.

As shown in FIG. 19, the valve assembly 1812 may include a cleanout passage 1908 through which an operator can release clogs or obstructions from the valve 1812. In the shown embodiment, the cleanout passage 1908 is located at the bottom of a dirt collector receptacle 1910. The dirt collector receptacle 1910 receives a removable dirt collector 108. The cleanout passage 1908 leads to the floor inlet 1902 portion of the valve assembly 1812, but it may lead to other parts of the valve assembly 1812 if desired. A plug (not shown) blocks the cleanout passage 1908 when it is not in use.

In embodiments in which the dirt collector 108 is not removable, the cleanout passage 1908 may be located in a bag chamber. In other embodiments the cleanout passage may be located elsewhere on the cleaning device 100. For example, the cleanout passage may be provided on the outer housing 302 of the rotating handle 1002.

As noted above, many vacuum cleaners are constructed to provide a parked position in which the vacuum cleaner stands upright on its own, and an operating position in which a portion of the vacuum cleaner is leaned back relative to the base. Providing a parked position requires the device to be supported on wheels or other structures that prevent tipping. For example, a typical upright vacuum cleaner may be supported by a pair of rear wheels and one or more front wheels in the parked position. To provide stability in the parked position, it is desirable to distribute the supporting wheels (or other support structures) around the device's center of gravity. In some cases, however, distributing the support members to provide stability in the parked position may reduce the maneuverability of the device when it is moved to the operating position. For example, providing a relatively large distance between front and rear support wheels on an upright vacuum cleaner base may provide desirable parked position stability, but also may provide a long fore-aft wheelbase that renders the vacuum cleaner relatively difficult to turn during operation. It is believed that the reduction in turning ability caused by a long wheelbase may be more apparent in vacuum cleaners having a rotating handle such as described above. In these cases, it may be possible to enhance the maneuverability of a cleaning device that is supported by front and rear wheels by reducing the distance between the front and rear wheels. Doing so is expected to reduce axial forces on the wheels to reduce sliding resistance to turning the cleaner side-to-side, but the present invention is not intended to be limited by any theory of operation. This also may be true for cleaning devices that are supported on devices other than wheels (e.g., skid plates, etc.).

Figure 21:
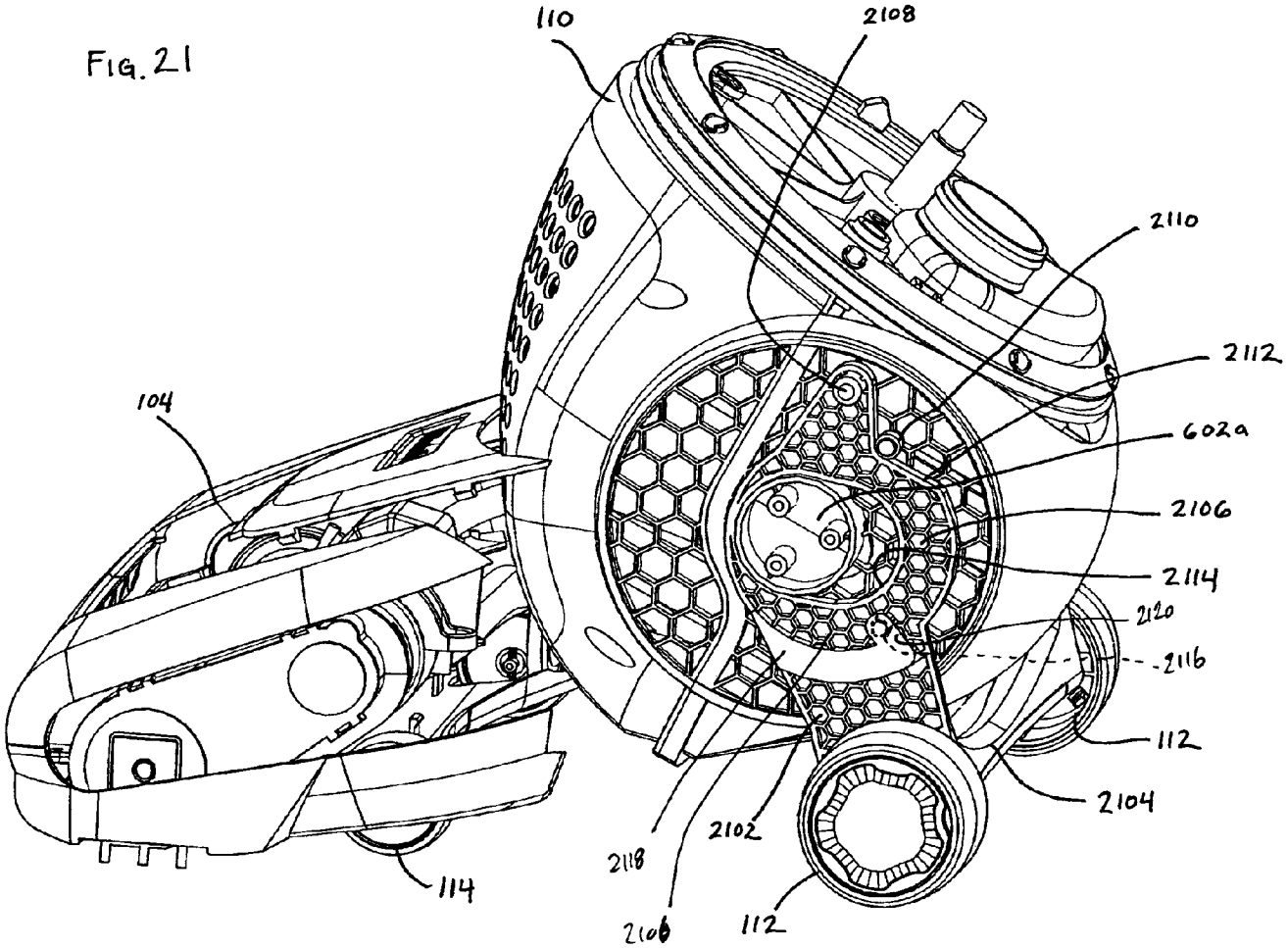
FIG. 21 illustrates an exemplary embodiment of a movable wheel arrangement for a cleaning device, shown in the parked position.
Figure 22:
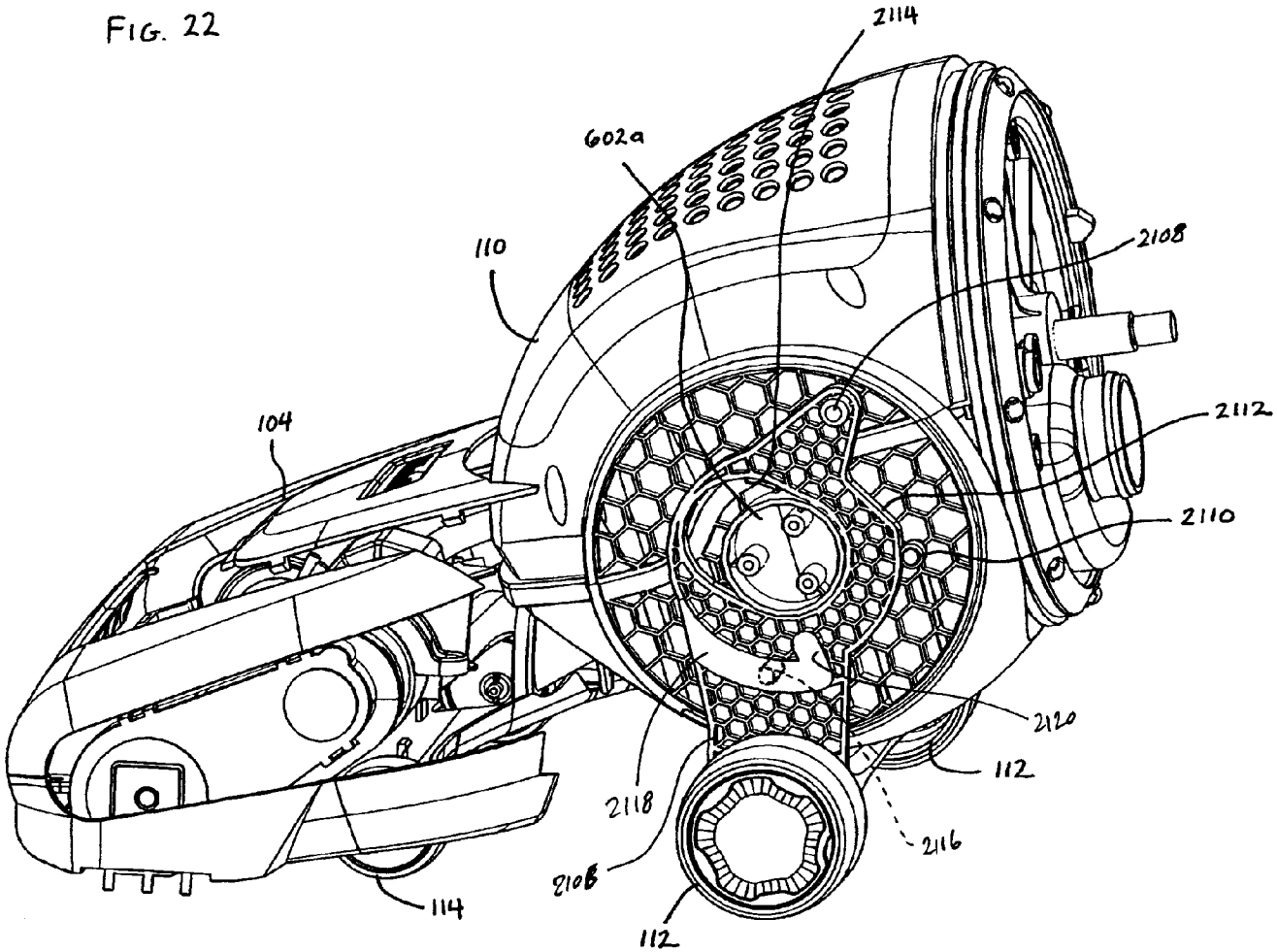
FIG. 22 illustrates the structure of FIG. 21, shown in the operating position.

FIGS. 21 and 22 illustrate one embodiment of a wheelbase altering arrangement that moves the rear wheels 112 forward relative to the base 104 when the cleaning device 100 is moved from the parked position to the operating position. In this exemplary embodiment, the rear wheels 112 are mounted on a wheel carriage 2102. The wheel carriage 2102 includes a main axle 2104 that joins the two wheels 112, and a pair of carriage yokes 2106 that extend upwards from each wheel 112. Each yoke 2106 has a mounting pin located at an end remote from the wheel 112. These mounting pins 2108 extend laterally away from the cleaning device centerline, and pivotally engage respective pivot holes 520 (FIG. 5) formed on the yoke arms 506 of the base 104. Thus, the wheel carriage 2102 straddles the motor housing 110, and is pivotally mounted to the base 104.

The wheel carriage 2102 pivots between a parked position, shown in FIG. 21, and an operating position, shown in FIG. 22. The parked position is assumed when the upper assembly 102 is in the parked position relative to the base 104, and the operating position is assumed when the upper assembly 102 is leaned back relative to the base 104. Any suitable mechanism may be used to pivot the wheel carriage 2102 between the two positions. In the illustrated exemplary embodiment, the wheel carriage 2102 is moved from the parked to the operating positions by a roller 2110 mounted on one or both sides of the motor housing 110. The roller 2110 comprises a rolling pin that contacts a cam surface 2112 formed on the wheel carriage 2102. The roller 2110 maintains a constant distance from the base pivot axis 118 as the motor housing 110 rotates about the base pivot axis 118. the cam surface 2112 has a notched end that is closer to the base pivot axis 118, and a distal end that is further from the base pivot axis 118. A transition region extends between the notched end and ramped end to provide a smooth surface on which the roller 2112 can move. When the motor housing 110 (and thus the upper assembly 102) is in the parked position, the roller 2110 is located at the notched first end of the cam surface 2112, which permits the wheel carriage 2102 to pivot rearward relative to the base 104. As the motor housing 110 is pivoted backwards relative to the base 104, the roller 2110 presses against the cam surface 2112 and rides up the transition surface to drives the wheel carriage 2102 forward. When the motor housing 110 rotates through a predetermined angle, the roller 2110 reaches the distal end of the cam surface 2112. The distal end of the cam surface 2112 may comprise an arced surface region that is generally equidistant from the base pivot axis 118, so that the motor housing 110 can continue to rotate backwards without driving the wheel carriage 2102 further forward.

When the motor housing 110 is returned to the upright parked position, the roller 2110 moves back to the notched portion of the cam surface 2112 and no longer applies a force to move the wheel carriage 2102 forward. Gravity, one or more springs, or movement of the vacuum cleaner may then move the wheel carriage 2102 back to the parked position. In addition, one or more additional rollers or pins may be used in the opposite fashion as the roller 2110 to physically force the wheel carriage 2102 back into the parked position when the motor housing 110 is pivoted forward relative to the base 104. For example, in one embodiment, return pins 2116 may extend laterally from one or both sides of the motor housing 110 in a similar manner as the roller 2110. The return pin 2116 is positioned in a respective slot 2118 in the side of the wheel carriage 2102. As the motor housing 110 is pivoted forward, the return pin 2116 slides freely within the slot 2118 until it contacts a return cam surface 2120 located at the end of the slot 2118. The pin 2116 makes contact with the return cam surface 2120 before the motor housing 110 has reached the full upright position, and further forward pivoting of the motor housing 110 presses the return pin 2116 against the return cam surface 2120 to drive the wheel carriage 2102 backwards relative about its pivot pin 2108.

The slots 2118 in the shown embodiment are formed as channels on the sides of the wheel carriage yokes 2106 that face the motor housing 110. The slots 2118 do not extend through the entire thickness of each wheel carriage yoke 2106, and therefore the return pins 2116 are not visible in the shown views, but the slots 2118 may alternatively be formed as full-depth channels in which case the pins 2116 would be visible. In other embodiments, the slots 2118 may substantially shortened or even omitted. For example, the return cam surface 2120 may be located on a front side of the carriage yokes 2106, in a similar manner as the cam surface 2112.

The forward and rearward pivoting travel of the wheel carriage 2102 may be constrained by any suitable travel stops. In the exemplary embodiment, the wheel carriage 2102 has a slot 2114 that surrounds the cylindrical post 602*a* that forms part of the pivoting connection between the motor housing 110 and the base 104. This slot 2114 permits the wheel carriage 2102 to move forwards and backwards, but stops its movement at the desired parked and operating positions.

Using the foregoing wheel carriage arrangement, the rear wheels 112 are moved forward to provide a more maneuverable short wheelbase when the cleaning device is in the operating position, but moved backwards to provide a more stable parked arrangement. In the forward position, the wheels 112 may be located approximately below the base pivot axis 118, but locations forward and rearward of the base pivot axis 118 are also possible. In the rearward position, the wheels 112 may be behind the base pivot axis 118 to provide additional stability when using an accessory hose 122, but other locations are possible. While this is expected to provide some benefits, this particular wheel-moving arrangement is not required in all embodiments, and nor is it required to provide a wheel-moving arrangement at all. It will also be understood other embodiments may use modified versions of the foregoing arrangement. For example, a roller 2110 is used to reduce friction between these parts, but if friction is not an issue, the roller 2110 may comprise a simple non-rolling pin or a simple protrusion extending from the motor housing. As another example, the roller 2110 and return pin 2116 may be mounted on the wheel carriage 2102, and cam surface to drive the roller and pin may be mounted on the motor housing 110. As yet another example, the wheel carriage drive mechanism may comprise cam surfaces on both the wheel carriage 2102 and the handle portion of the vacuum cleaner, and may not use a part shaped as a pin or roller. As another example, the roller 2110 or other structure may be mounted on another part of the handle than a motor housing 110. These and other variations will be apparent to persons of ordinary skill in the art in view of the present disclosure.

The embodiments described herein are not intended to limit the scope of the inventions recited in the appended claims. Furthermore, the claimed inventions may be practiced in any number of other ways, and, where suitable, in other contexts. For example, although many of the embodiments disclosed herein have been described with reference to floor cleaning devices, and in particular to an upright vacuum cleaner, the principles herein are equally applicable to other types of devices. For example, embodiments may be practiced in the context of canister and central vacuum powerheads, and in the context of other equipment, such as industrial floor cleaning or treating devices. It will also be understood that the exemplary features described herein may be used together, separately, or in various combinations. Various other modifications of the embodiments of the present inventions, in addition to those described herein, will be apparent to those of ordinary skill in the art from the foregoing description and accompanying drawings. Such modifications are intended to fall within the scope of the following appended claims. Accordingly, the claims set forth below should be construed broadly to encompass the full breath and spirit of the claimed inventions.

The invention claimed is:

1. A vacuum cleaner comprising:

a base adapted to move on a surface and having a base air inlet facing the surface;

an intermediate member having a first intermediate member passage and a second intermediate member passage;

a first joint connecting the base to the intermediate member, the first joint permitting relative rotation between the base and the intermediate member about a first axis that is generally parallel to the surface and perpendicular to a nominal direction of movement of the vacuum cleaner;

a base air passage fluidly connecting the base air inlet to the first intermediate member passage;

a handle having a grip adapted to be held by an operator and a dirt collector having a collector inlet and a collector outlet, the dirt collector being adapted to receive air into the collector inlet, separate dirt from the air, and exhaust the air out of the collector outlet;

a second joint connecting the handle to the intermediate member, the second joint permitting relative rotation between the intermediate member and the handle about a second axis that is generally parallel to a plane that is perpendicular to the first axis;

a first handle air passage connecting the first intermediate member passage to the dirt collector inlet;

a second handle air passage connecting the second intermediate member passage to the dirt collector outlet; and a vacuum fan adapted to selectively draw the air into the base air inlet, through the base air passage, through the first intermediate member passage, through the dirt collector, through the second handle air passage, and into the second intermediate member passage, in that order;

wherein of the first handle air passage and the second handle air passage each comprise a respective separate hose that is offset from the second axis and is adapted to flex to permit the handle to rotate relative to the intermediate member.

2. The vacuum cleaner of claim 1, wherein at least one of the first handle air passage and the second handle air passage extends generally parallel to the second axis when the handle is oriented at a predetermined rotation with respect to the intermediate member.

3. The vacuum cleaner of claim 1, wherein the first handle air passage and the second handle air passage extend along axes that do not intersect the second axis.

4. The vacuum cleaner of claim 1, wherein the vacuum cleaner has a front side and a rear side, and wherein the first joint permits relative rotation of the intermediate member relative to the base between a parked position and an operating position that is inclined from the parked position towards the rear side of the vacuum cleaner.

5. The vacuum cleaner of claim 4, wherein the second axis is inclined, relative to a vertical direction, towards the rear side of the vacuum cleaner.

6. The vacuum cleaner of claim 5, wherein the second axis is inclined towards a rear side of the vacuum cleaner at an angle of about 20 degrees to about 40 degrees from a plane defined by the base air inlet when the intermediate member is in the parked position.

7. The vacuum cleaner of claim 5, wherein the second axis is inclined towards a rear side of the vacuum cleaner at an angle of at least about 80 degrees from a plane defined by the base air inlet when the intermediate member is in a fully-reclined operating position.

8. The vacuum cleaner of claim 1, wherein the vacuum fan is contained in the intermediate member.

9. The vacuum cleaner of claim 1, wherein the base air passage comprises a rigid pipe having a first end connected to the base, and an outlet connected to the first intermediate member passage at a point along the first axis.

10. The vacuum cleaner of claim 1, wherein the second joint comprises a pivot pin and a central boss that fits over the pivot pin, the pivot pin and central boss being located along the second axis.

11. The vacuum cleaner of claim 10, wherein the second joint comprises a bearing assembly that is radially displaced from the second axis, the bearing assembly comprising a first bearing race connected to the intermediate member, a second bearing race connected to the handle, and a plurality of bearings between the first bearing race and the second bearing race.

12. The vacuum cleaner of claim 10, wherein the second joint comprises a bearing assembly that is radially displaced from the second axis, and radially outward of the first handle air passage and the second handle air passage.

13. The vacuum cleaner of claim 1, wherein the second joint comprises a bearing assembly that is radially displaced from the second axis and surrounds the first handle air passage and the second handle air passage.

14. The vacuum cleaner of claim 1, wherein the first handle air passage and the second handle air passage are contained entirely within one or more rigid outer housings of at least one of the handle and the intermediate member.

15. The vacuum cleaner of claim 1, further comprising a valve fluidly connected in series with the first handle air passage and upstream of the dirt collector, the valve being movable between a floor cleaning position in which the dirt collector is in fluid communication with the base air inlet, and an accessory cleaning position in which the dirt collector is in fluid communication with one or more accessory cleaning implements and not in fluid communication with the base air inlet.

16. The vacuum cleaner of claim 15, wherein the one or more accessory cleaning implements comprises a hose and a wand, the wand being selectively connectable to the handle and having the grip formed thereon.

17. The vacuum cleaner of claim 1, further comprising a pivot lock adapted to retain the handle in a predetermined position with respect to the intermediate member.

18. The vacuum cleaner of claim 17, wherein the pivot lock comprises:

a pin slideably mounted to the intermediate member;

a detent formed in the handle; and a spring positioned to bias the pin towards the detent;

wherein the pin and detent are positioned such that the pin enters the detent by a force applied at least in part by the spring when the handle is in the predetermined position with respect to the intermediate member.

19. The vacuum cleaner of claim 18, wherein the pivot lock further comprises a spring receptacle movably mounted to the intermediate member, and the spring is operatively mounted between the spring receptacle and the pin, wherein the spring receptacle is movable from a first position to compress the spring against the pin to thereby generate the force to move the pin into the detent, and a second position in which the spring is not substantially compressed against the pin to thereby reduce or eliminate the force to move the pin into the detent.

20. The vacuum cleaner of claim 19, wherein the spring receptacle is mounted to the intermediate member at a location facing the base or the base air passage, such that the intermediate member contacts the base or the base air passage when the intermediate member is rotated into an upright position with respect to the base to thereby move the spring receptacle to the first position.

21. The vacuum cleaner of claim 18, wherein at least one of the pin and the detent is beveled to permit the pivot lock to be defeated by the application of sufficient force to rotate the handle relative to the intermediate member.

22. A vacuum cleaner comprising:

a base adapted to move on a surface and having a base air inlet facing the surface;

an intermediate member having a vacuum fan housed therein;

a first joint connecting the base to the intermediate member, the first joint permitting relative rotation between the base and the intermediate member about a first axis that is generally parallel to the surface and perpendicular to a nominal direction of movement of the vacuum cleaner;

a handle having a grip adapted to be held by an operator and a dirt collector having a collector inlet and a collector outlet, the dirt collector being adapted to receive air into the collector inlet, separate dirt from the air, and exhaust the air out of the collector outlet;

a second joint connecting the handle to the intermediate member, the second joint permitting relative rotation between the intermediate member and the handle about a second axis that is generally parallel to a plane that is perpendicular to the first axis;

a first air passage fluidly connecting the base air inlet to the dirt collector inlet and a second air passage fluidly connecting the dirt collector outlet to the vacuum fan, of the first air passage and the second air passage each comprising a respective separate flexible hose that passes the second joint at a location offset from the second axis;

wherein the vacuum fan is adapted to draw the air into the base air inlet, through the first air passage, through the dirt collector, and through the second air passage, and into the vacuum fan, in that order and wherein at least one of the first air passage and the second air passage has a central axis that is offset from the second axis.

23. A vacuum cleaner comprising:

a base adapted to move on a surface and having a base air inlet facing the surface;

an intermediate member;

a first joint connecting the base to the intermediate member, the first joint permitting relative rotation between the base and the intermediate member about a first axis that is generally parallel to the surface and perpendicular to a nominal direction of movement of the vacuum cleaner;

a handle having a dirt collector having a collector inlet and a collector outlet, the dirt collector being adapted to receive air into the collector inlet, separate dirt from the air, and exhaust the air out of the collector outlet;

a second joint connecting the handle to the intermediate member, the second joint permitting relative rotation between the intermediate member and the handle about a second axis that is generally parallel to a plane that is perpendicular to the first axis, the second joint comprising at least one bearing having a bearing perimeter that is radially offset from the second axis;

a first air passage fluidly connecting the base air inlet to the dirt collector inlet; and a second air passage fluidly connecting the dirt collector outlet to the vacuum fan;

wherein the first air passage and the second air passage comprise respective flexible hoses, the flexible hoses passing the second joint at a location within the bearing perimeter.

24. The vacuum cleaner of claim 23, wherein the first air passage and the second air passage each comprise a respective separate hose that is offset from the second axis.

25. The vacuum cleaner of claim 23, wherein the vacuum cleaner has a front side and a rear side, and wherein the first joint permits relative rotation of the intermediate member relative to the base between a parked position and an operating position that is inclined from the parked position towards the rear side of the vacuum cleaner.

26. The vacuum cleaner of claim 23, wherein the vacuum fan is contained in the intermediate member.

27. The vacuum cleaner of claim 23, wherein the second joint comprises a pivot pin and a central boss that fits over the pivot pin, the pivot pin and central boss being located along the second axis.

28. The vacuum cleaner of claim 23, wherein the first air passage and the second air passage are contained entirely within one or more rigid outer housings of at least one of the handle and the intermediate member.

29. The vacuum cleaner of claim 23, further comprising a pivot lock adapted to retain the handle in a predetermined position with respect to the intermediate member.

* * * * *

UNITED STATES PATENT AND TRADEMARK OFFICE

CERTIFICATE OF CORRECTION

PATENT NO. : 8,448,295 B2
APPLICATION NO. : 12/722901
DATED : May 28, 2013
INVENTOR(S) : Donald Davidshofer and Brian Vines It is certified that error appears in the above-identified patent and that said Letters Patent is hereby corrected as shown below:

In the Claims:

In Column 20, line 3, "of" should be deleted.

In Column 22, line 1, "of" should be deleted.

In Column 22, lines 8-11, "and wherein at least one of the first air passage and the second air passage has a central axis that is offset from the second axis." should be deleted.

In Column 22, line 8, -- . -- should be added after the word order.

In Column 22, line 42, -- ; and wherein at least one of the first air passage and the second air passage has a central axis that is offset from the second axis -- should be added after the word "perimeter".

Signed and Sealed this
Tenth Day of September, 2013

Teresa Stanek Rea
*Acting Director of the United States Patent and Trademark Office*